US007533965B2

(12) United States Patent
Steiner

(10) Patent No.: US 7,533,965 B2
(45) Date of Patent: May 19, 2009

(54) APPARATUS AND METHOD FOR ELECTROSTATICALLY CHARGING FLUID DROPS

(75) Inventor: Thomas W. Steiner, Burnaby (CA)

(73) Assignee: Eastman Kodak Company, Rochester, NY (US)

( * ) Notice: Subject to any disclaimer, the term of this patent is extended or adjusted under 35 U.S.C. 154(b) by 468 days.

(21) Appl. No.: 11/368,565

(22) Filed: Mar. 6, 2006

(65) Prior Publication Data

US 2006/0197803 A1 Sep. 7, 2006

Related U.S. Application Data

(60) Provisional application No. 60/658,571, filed on Mar. 7, 2005.

(51) Int. Cl.
*B41J 2/06* (2006.01)

(52) U.S. Cl. ..... 347/55; 347/44

(58) Field of Classification Search ..... 347/12, 347/13, 20, 40, 42, 44, 54, 55, 73–77, 47, 347/82

See application file for complete search history.

(56) References Cited

U.S. PATENT DOCUMENTS

| | | | | |
|---|---|---|---|---|
| 1,941,001 | A | 12/1933 | Hansell | 178/96 |
| 3,373,437 | A | 3/1968 | Sweet et al. | 347/74 |
| 3,404,221 | A | 10/1968 | Loughren | 347/100 |
| 3,560,641 | A | 2/1971 | Taylor et al. | 358/296 |
| 3,562,757 | A | 2/1971 | Bischoff | 347/76 |
| 3,596,275 | A | 7/1971 | Sweet | 347/74 |
| 3,604,980 | A | 9/1971 | Robertson | 347/76 |
| 3,656,171 | A | 4/1972 | Robertson | 347/76 |
| 3,701,998 | A | 10/1972 | Mathis | 347/75 |
| 3,828,354 | A | 8/1974 | Hilton | 347/74 |
| 3,972,051 | A | 7/1976 | Lundquist et al. | 347/74 |
| 4,014,029 | A | 3/1977 | Lane et al. | 347/47 |
| 4,373,387 | A * | 2/1983 | Nishimura et al. | 73/204.19 |
| 4,395,716 | A | 7/1983 | Crean et al. | 347/76 |
| 4,550,323 | A | 10/1985 | Gamblin | 347/76 |
| 4,596,990 | A | 6/1986 | Hou | 347/41 |

(Continued)

FOREIGN PATENT DOCUMENTS

| | | |
|---|---|---|
| EP | 0 104 951 | 9/1983 |

OTHER PUBLICATIONS

Bazelyan, E.M. and Raizer, Yu.P.; Spark Discharge; CRC Press Boca Raton (1998); pp. 31-32.

(Continued)

*Primary Examiner*—Juanita D Stephens
(74) *Attorney, Agent, or Firm*—William R. Zimmerli; Nelson Adrian Blish

(57) ABSTRACT

A continuous printing apparatus includes a printhead including a first row of nozzles and a second row of nozzles. The first row of nozzles are spaced apart from the second row of nozzles by a distance A. The nozzles of the first row and the nozzles of the second row have a nozzle to nozzle spacing B when compared to each other. The apparatus includes a plurality of charging electrodes with one of the plurality of charging electrodes corresponding to each of the nozzles of the first row and the second row, wherein A≧B/2. The apparatus can include a first deflection electrode and a second deflection electrode with the first deflection electrode being spaced apart from the second deflection electrode by a distance D, wherein D>A.

19 Claims, 20 Drawing Sheets

U.S. PATENT DOCUMENTS

| | | | | |
|---|---|---|---|---|
| 4,809,016 | A | 2/1989 | Padalino | 347/41 |
| 4,972,270 | A * | 11/1990 | Kurtin et al. | 358/296 |
| 5,892,524 | A | 4/1999 | Silverbrook | 347/15 |
| 6,457,807 | B1 | 10/2002 | Hawkins et al. | 347/40 |
| 6,536,883 | B2 | 3/2003 | Hawkins et al. | 347/77 |
| 2004/0263586 | A1 | 12/2004 | Steiner | 347/74 |

OTHER PUBLICATIONS http://home.earthlink.net/~jimlux/hv/paschen.htm, Paschen's Law; Jim Lux; Feb. 9, 2004; copyright 1997, pp. 1-3.

* cited by examiner

APPARATUS AND METHOD FOR ELECTROSTATICALLY CHARGING FLUID DROPS

CROSS REFERENCE TO RELATED APPLICATIONS

This is a 111A application of Provisional Application Ser. No. 60/658,571 filed Mar. 7, 2005.

FIELD OF THE INVENTION

The invention pertains to the field of ink-jetting of fluids and, in particular, to construction of a high-resolution CIJ head for use in continuous inkjet systems.

BACKGROUND OF THE INVENTION

The use of ink jet printers for printing information on a recording media is well established. Printers employed for this purpose may be grouped into those that use a continuous stream of fluid drops and those that emit drops only when corresponding information is to be printed. The former group is generally known as continuous inkjet printers and the latter as drop-on-demand inkjet printers. The general principles of operation of both of these groups of printers are very well recorded. Drop-on-demand inkjet printers have become the predominant type of printer for use in home computing systems, while continuous inkjet systems have found a major application in industrial and professional environments.

Continuous inkjet printers typically have a print-head that incorporates a fluid supply system and a nozzle plate with one or more ink nozzles fed by the fluid supply system. Fluid streams are consequently jetted from the one or more ink nozzles. In order to create the ink drops, a drop generator is associated with the print-head. The drop generator influences the fluid streams within and just beyond the print-head by a variety of mechanisms discussed in the art. This is done at a frequency or multiple frequencies that forces these thread-like fluid streams to be broken up into corresponding continuous streams of drops at a point within the vicinity of the nozzle plate. Specific drops within these continuous streams of drops are then selected to be printed with or to not be printed with.

The means for selecting printing drops from non-printing drops within the continuous stream in drops have been well described in the art. One commonly used practice is that of electrostatically charging and electrostatically deflecting selected drops as described by Hansell in U.S. Pat. No. 1,941,001, and by Sweet et. al. in U.S. Pat. No. 3,373,437. In these patents, a charge electrode is positioned adjacent to a fluid stream at a point in which the corresponding continuous stream of drops forms. The function of the charge electrode is to selectively charge the fluid drops as the drops break off from the jet. This is possible because the jetted fluid has conductive properties. One or more electrostatic deflection plates positioned downstream from the charge electrodes deflect a charged fluid drop either into a gutter assembly or onto a recording media. For example, the drops to be guttered are charged and consequently deflected into the gutter assembly and those intended to print on the recording surface are not charged and continue un-deflected towards the recording surface. In some systems, this arrangement is reversed and the uncharged drops are guttered while the charged ones are ultimately printed. Electrostatic systems are advantageous in that they permit large drop deflections.

In electrostatic continuous inkjet systems in which such charging is required, various forms of charge electrodes have been described in the prior art for charging drops as they break off from fluid stream. Charge electrodes previously used in the art have typically comprised an electrically conductive material coated onto a nonconductive substrate. As disclosed by Loughren in U.S. Pat. No. 3,404,221, and by Sweet et. al. in U.S. Pat. No. 3,373,437, early charged elctrodes utilized cylindrically shaped hollow rings or tubes or U-shaped channels. However, the accurate placement of the tubes or channels into a support structure and then electrically connecting such devices to a signal source was both difficult and time consuming especially in multi-jet systems utilizing hundreds of individual streams of ink drops spaced only a few thousandths of an inch apart. Other charge electrode configurations have also included structures that partially enclose the fluid stream such as U or V-shaped electrodes.

Another example of charge electrodes was disclosed by Robertson in U.S. Pat. Nos. 3,604,980 and 3,656,171 in which a dielectric planar surface has plated thereon a series of strips of electrically conductive material, each connected to a charging signal source. The "planar" charge electrode disclosed by Robertson differs from other prior art charge electrodes in that the conductive strips do not completely surround surround the drop streams. Rather, the charge planar charge elcetrodes disclosed by Robertson are offset to one side of the jets emitted by corresponding nozzles. The compact nature and form of planar charge electrodes may make them suitable for state of the art high-resolution continuous inkjet systems that incorporate a high number of very closely spaced nozzles. In this context, "high-resolution" refers to an effective native drop generator spacing on the order of 500 drops/inch (dpi) or greater.

Prior art electrostatic continuous inkjet systems have mostly employed either a single inkjet nozzle, or a single row of nozzles. Attempts have been made in the prior art to increase the resolution of such devices. In U.S. Pat. No. 3,560,641, Taylor et al. discloses offsetting one or more rows of nozzles from one another in the direction of the nozzle array, in order to achieve a greater effective pixel density. Electrostatic continuous inkjet printing systems employing more than one row of inkjet nozzles are however typically, older systems with relatively large nozzle-to-nozzle separations. Further, these systems typically have relatively large inter-row separations usually on the order many hundreds of microns or even several millimeters. In U.S. Pat. No. 3,701,998, Mathis discloses a continuous inkjet apparatus in which twin rows of nozzles are separated from on another by 400 microns. This large separation is in part due to the fact that a drop deflection means comprising an electrically conductive strip is positioned between the two rows of continuous drop streams that are generated. In one embodiment of the "998" patent, the electrically conductive strip is grounded such that oppositely charged non-printing drops are guttered to opposing sides of the print-head. In U.S. Pat. No. 4,596,990, Hou discloses a dual row print-head wherein the jets are separated by 1-3 mm, and drops within each jet are separated by 152 um. Hou claims that the coulombic interactions between the adjacent jets are very small. Rows in the above patent are spaced by as much as 3 to 6 mm apart.

The spatial requirements of these prior art systems make them unsuitable for use in of state of the art high-resolution (i.e. 500 dpi or greater) electrostatic inkjet systems. These high-resolution systems require a large number of continues streams of very small drops to be formed and the drop to drop separation within a given stream must be much smaller than those of the prior art. Additionally, nozzle-to-nozzle separations, whether between jets in a given row, or additionally between rows in a multi-row system must conform to the small separations requirements of these high-resolutions. Different methods have been used to increase drop resolution. Micromachining manufacturing techniques have been employed to produce multiple rows of very closely spaced nozzles. Silverbrook has described in U.S. Pat. No. 5,892,524 a drop-on demand printer constructed using these micromachining techniques with nozzle-to-nozzle separations under 100 um. Further, an inkjet printer in which thermally stimulated drop separation is employed with nozzle-to-nozzle separations also under 100 um is described by Hawkins et. al. in U.S. Pat. No. 6,536,883, and also in U.S. Pat. No. 6,457,807. In these prior art systems, electrostatic charging and separation of drops is not employed.

Multi-jet continuous inkjet systems comprising electrostatic drop charging and separation architectures have proven themselves to be reliable and successfully capable of producing quality images at low to mid resolutions. However, high-resolution versions of these continuous inkjet printers, especially those requiring multiple rows of closely spaced nozzles, are however subject to undesirable electrostatic challenges when electrostatic drop charging and separation architectures are employed. In these high-resolution electrostatic systems, challenges including effective drop charging (i.e. charge coupling), as well as electrostatic nozzle-to-nozzle crosstalk and drop-to-drop electrostatic crosstalk, effects are further compounded and amplified by the spatial requirements imposed by a high-resolution architecture.

As previously stated, planar charge electrodes may be considered for such high-resolution printers because of their very compact nature. Additionally, the construction of planar charge electrodes is suited to standard thin film manufacturing techniques commonly used in the electronics industry. The planar charge electrodes may also be manufactured using a variety of other techniques including micromachining (MEMS). However, when closely spaced nozzle arrays as required by a high-resolution print-head are considered, effective charge coupling between any given charge electrode and its respective drop stream may not be enough to ensure minimal charge variations among the charged drops. The tight spatial requirements of high-resolution CIJ print-heads can lead to undesirable charge variations caused by indirect electrostatic effects between neighboring charge electrodes and a given drop stream. These charge variations will affect drops selected for printing, as well as drops selected for guttering within the given stream. Print drop charge variation will affect print quality by affecting the drop placement accuracy on the recording surface. Charge variation in drops not selected for printing, will affect the ability to effectively gutter and recycle the unprinted ink, impacting the reliability of the print-head. In the later case, the print-head length must typically be increased to accommodate a gutter that is long enough to capture non-printing drops that have not been fully charged. This longer print-head in turn amplifies any pointing errors associated with the print drops since they must now travel a longer distance to the recording surface. Poor print quality can thus offset the gains in higher print image resolution.

Poor print quality can occur when drops that are intended to remain uncharged, or are intended to have some specific amount of charge, actually have additional charge induced by the charge electrodes of adjacent or nearby nozzles. These adjacent or nearby charge electrodes may correspond to neighboring nozzles within a given row of nozzles or they may correspond to the neighboring nozzles within another row of nozzles. This "nozzle-to-nozzle" electrostatic crosstalk effect created by the associated charge electrodes of neighboring nozzles is particular prevalent when planar charge electrodes are employed. Unlike prior art charge electrodes that completely surrounded their associated drop streams, planar electrodes by their design, cannot easily do this. Consequently, the shielding effects that prior art tunnel charge electrodes provided between adjacent nozzles is not readily provided by planar electrodes, thus increasing the occurrence of nozzle-to-nozzle crosstalk effects.

In addition to nozzle-to-nozzle crosstalk effects, other undesired electrostatic crosstalk effects can manifest themselves within a high-resolution CIJ printer. The very high speed printing performance and small drop size requirements of current state of the art continuous inkjet recording systems require that the fluid streams be stimulated such that the resulting continuous streams of drops are made up of very closely spaced drops. In this situation, "drop-to-drop" electrostatic crosstalk can occur between consecutive drops emitted by a given nozzle. When drop-to-drop cross talk does occur within a given drop stream, a drop currently being charged may have its resulting charge adversely influenced by charge distortions created by the electric fields of preceding adjacent drops. These additional electric fields may prevent a specific drop from being charged with the correct charge level and thus lead to additional print quality issues.

Several approaches have been noted in the prior art to reduce drop-to-drop electrostatic crosstalk effects. In U.S. Pat. No. 3,562,757, Bischoff describes how the use of a number of "guard drops" between successive charged print drops acts as a shield to minimize the adverse cross-talk effects that the electric field of one charged drop has on the subsequent formation of another charged drop. A guard drop is a drop that is not used for printing, but which serves the sole function of separating a print drops within a drop stream, thereby reducing drop-to-drop crosstalk. Additionally, Bischoff states that this guard drop scheme further improves the aerodynamics of the drop trajectories. Specifically, Bischoff explains that every emitted drop leaves in its wake a region of turbulence that causes variability in the required trajectory of a following drop that enters the region of turbulence. When guard drops are employed, they are subsequently separated from the drops to be printed by the charge deflection plates. Therefore when the guard drops are separated, the spacing between the remaining "printable" drops is increased and the effects of turbulence are substantially reduced.

Needless to say, both the drop-to-drop crosstalk effects and the nozzle-to-nozzle crosstalk effects can further combine to compound the undesired charging effects that can occur in high-resolution multi-row continuous inkjet print-heads. In these systems the required charge level on a specific drop emitted from a given nozzle will be affected by charges on drops previously emitted in the drop stream of the given nozzle, as well as by the charges on drops previously and concurrently emitted in nearby nozzle drop streams.

The prior art has proposed several solutions to counter the undesired electrostatic charge effects created by the combined drop-to-drop and nozzle-to-nozzle crosstalk phenomenon. In European Patent Application No. 0104951, Paranjpe describes a dual row continuous inkjet system in which a pattern of charged guard drops are provided to isolate print drops from undesired electrostatic effects of other drops. In the "951" patent application, the guard drops in both rows are charged with a single polarity charge and the print drops are not charged or are slightly charged so as to print onto multiple positions on a recording media. A central deflection electrode that is positioned between the dual rows of nozzles deflects the single polarity guard drops outwardly. According to this approach, one or more guard drops are provided between print drops in each stream to reduce drop-to-drop crosstalk, and one or more guard drops are provided between print drops in each row to reduce nozzle-to-nozzle crosstalk. Paranjpe proposes various arrangements of guard drops and print drops.

Additionally, charge compensation schemes have further been proposed to minimize electrostatic crosstalk effects that give rise to non-optimal print drop placement. In U.S. Pat. No. 3,828,354, Hilton discloses such a charge compensation scheme. These approaches are suitable for low-density print-heads, but for state-of-the-art systems with high-resolutions and hundreds or thousands of nozzles per print-head, these methods become expensive. It is desirable to use less expensive digital circuitry to drive the many charge electrodes on a high-resolution print-head to avoid the cost associated with large numbers of analog drivers and associated systems controllers to determine the proper drive level.

As previously stated, drop trajectories can also be additionally adversely affected by aerodynamic effects. Although guard drop schemes may help in this regard, the prior art has taught additional methods to reduce these effects. In U.S. Pat. No. 3,596,275, Sweet discloses the utilization of a gas stream, such as air, to compensate for the aerodynamic drag on the ink drops. In U.S. Pat. No. 3,972,051 Lundquist et al discloses adjusting the airflow such that it remains laminar with a Reynolds number of less than 2300. Gas flow assist as disclosed by the prior art has for the most part been applied on a single nozzle or single row of nozzles.

Clearly, producing a reliable, high quality high-resolution electrostatic CIJ print-head requires consistent drop charge coupling as well as over coming the aforementioned drop-to-drop and nozzle-to-nozzle crosstalk effects and the aerodynamic effects. Additionally, an effective deflection field is required to minimize the time of flight of emitted drops. Reducing the drop time-of-flight minimizes the amount of time that any remaining crosstalk and aerodynamic effects can have on the trajectory of the drop, thus reducing print errors. In U.S. Pat. No. 4,395,716, Crean et al. discloses a bipolar swathing inkjet printer, wherein the deflection field has an electrical field strength that is slightly less than the breakdown field strength of air for the environment in which the printer is to operate in.

As further print resolution improvements are required and nozzle structures are manufactured using micromachining methods, it is clear that there remain challenges when designing high-resolution continuous inkjet systems requiring superlative drop placement accuracy.

It would be advantageous to provide a multi-row electrostatic CIJ print-head with high native resolution of 500 dpi or greater. Such a high-resolution CIJ print-head should comprise a charging means operable for maintaining a high degree of charge coupling with each drop, while introducing a low amount of influence charging.

It would also be advantageous to provide such a high-resolution CIJ print-head with a charging means capable of also minimizing nozzle-to-nozzle and drop-to-drop crosstalk effects.

It would additionally be advantageous to provide such a high-resolution CIJ print-head with a gas system capable of maintaining a uniform laminar flow across each of the multi-rows of nozzles, thus minimizing the undesired aerodynamic effects among the drop streams emitted by the multi-rows of nozzles.

It would further be advantageous to provide such a high-resolution CIJ print-head with a drop deflection means capable of reducing the time of flight of charged drops and thus reducing the time for adverse electrostatic crosstalk and aerodynamic effects to alter the desired trajectory of the drops.

Finally, it would be advantageous that such a multi-row electrostatic CIJ print-head be produced by state-of-the art micromachining fabrication methods to produce a compact print-head suitable for print resolutions of 500 dpi or greater. Further, it would be advantageous for the print-head length in the direction of jetting be as short as possible so that the nozzle to recording surface distance is minimized, further reducing time-of-flight errors and drop placement errors due to the residual jet pointing error of the nozzles. Such a print-head should gutter non-printing drops in the shortest path possible.

SUMMARY OF THE INVENTION

In one aspect of the present invention, a continuous printing apparatus comprises a printhead including a first row of nozzles and a second row of nozzles, the first row of nozzles being spaced apart from the second row of nozzles by a distance A, the nozzles of the first row and the nozzles of the second row having a nozzle to nozzle spacing B when compared to each other; and a plurality of charging electrodes, one of the plurality of charging electrodes corresponding to each of the nozzles of the first row and the second row, wherein $A \geqq B/2$.

The apparatus can include a first deflection electrode and a second deflection electrode with the first deflection electrode being spaced apart from the second deflection electrode by a distance D, wherein $D>A$.

Each of the plurality of charging electrodes can be positioned spaced apart from its corresponding nozzle by a distance C with each of the plurality of charging electrodes having a width W as viewed in a direction substantially perpendicular to the first row of nozzles, wherein $0.05 \leqq C/W \leqq 0.75$, and preferably $0.05 \leqq C/W \leqq 0.50$.

The nozzles of the first row and the nozzles of the second row can be offset relative to each other as viewed in a direction substantially perpendicular to the first row of nozzles. The nozzles of the first row can have a nozzle to nozzle spacing of 2B. An area between the first row of nozzles and the second row of nozzles can be free of electrostatic shielding.

In another aspect of the present invention, a method of printing comprises forming fluid streams by causing fluid to jet through nozzles of a first row of nozzles and a second row of nozzles, the first row of nozzles being spaced apart from the second row of nozzles by a distance A, the nozzles of the first row and the nozzles of the second row having a nozzle to nozzle spacing B when compared to each other; creating fluid drops from the fluid streams using a drop generator; selectively charging the fluid drops using a plurality of charging electrodes, one of the plurality of charging electrodes corresponding to each of the nozzles of the first row and the second row; and deflecting the charged fluid drops toward one of a gutter and a recording medium using a first deflection electrode and a second deflection electrode, the first deflection electrode being spaced apart from the second deflection electrode by a distance D, wherein $D>A \geqq B/2$.

In another aspect of the present invention, a continuous printing apparatus comprises a printhead including a first row of nozzles and a second row of nozzles, the first row of nozzles being spaced apart from the second row of nozzles by a distance A, the nozzles of the first row and the nozzles of the second row having a nozzle to nozzle spacing B when compared to each other; and a first deflection electrode and a second deflection electrode, the first deflection electrode being spaced apart from the second deflection electrode by a distance D, wherein $D>A\geqq B/2$.

The apparatus can include a plurality of charging electrodes with one of the plurality of charging electrodes corresponding to each of the nozzles of the first row and the second row.

Each of the plurality of charging electrodes can be positioned spaced apart from its corresponding nozzle by a distance C with each of the plurality of charging electrodes having a width W as viewed in a direction substantially perpendicular to the first row of nozzles, wherein $0.05\leqq C/W\leqq 0.75$, and preferably $0.05\leqq C/W\leqq 0.50$.

The nozzles of the first row and the nozzles of the second row can be offset relative to each other as viewed in a direction substantially perpendicular to the first row of nozzles. The nozzles of the first row can have a nozzle to nozzle spacing of 2B. An area between the first row of nozzles and the second row of nozzles can be free of electrostatic shielding.

In another aspect of the present invention, an electrostatic continuous inkjet printing apparatus comprises one or more print-heads. Each of the one or more print-heads comprises a first row of nozzles operable for emitting a first plurality of continuous fluid jets in a jetting direction. One or more stimulation means is operable for stimulating the first plurality of continuous fluid jets to form a corresponding first plurality of continuous streams of drops. A first plurality of planar charge electrodes corresponding to the first plurality of continuous fluid jets is also provided. At least one of the first plurality of planar charge electrodes is positioned by a distance $C_1$ to one side of a member of the first plurality of continuous fluid jets and is operable for a charging of one or more drops of a member of the corresponding first plurality of continuous streams of drops associated with the member of the first plurality of continuous fluid jets. The least one of the first plurality of planar charge electrodes comprises a width $W_1$ extending in a direction substantially perpendicular to the jetting direction and is sized and positioned such that $0.05\leqq C_1/W_1\leqq 0.75$, and more preferably, $0.05\leqq C_1/W_1\leqq 0.50$.

The each of the one or more print-heads may also comprise a second row of nozzles, wherein the second row of nozzles is spaced apart from the first row of nozzles and is operable for emitting a second plurality of continuous fluid jets in a jetting direction. The one or more stimulation means is further operable for stimulating the second plurality of continuous fluid jets to form a corresponding second plurality of continuous streams of drops. A second plurality of planar charge electrodes corresponding to the second plurality of continuous fluid jets is also provided. At least one of the second plurality of planar charge electrodes is positioned by a distance $C_2$ to one side of a member of the second plurality of continuous fluid jets and is operable for a charging of one or more drops of a member of the corresponding second plurality of continuous streams of drops associated with the member of the second plurality of continuous fluid jets. The least one of the second plurality of planar charge electrodes comprises a width $W_2$ extending in a direction substantially perpendicular to the jetting direction and is sized and positioned such that $0.05\leqq C_2/W_2\leqq 0.75$, and more preferably, $0.5\leqq C_2/W_2\leqq 0.50$.

The first and second plurality of planar charge electrodes may be sized and positioned such that $C_1=C_2$, and $W_1=W_2$. The first row of nozzles may also be offset from the second row of nozzles in a direction substantially parallel to a row of nozzles. The electrostatic continuous inkjet printing apparatus may include two deflection electrodes operable for creating a single deflection field across the corresponding first and corresponding second plurality of continuous streams of drops. Drops within the corresponding first plurality of continuous streams of drops may be charged positively and deflected outwardly into a first guttering means by the second deflection field. Drops within the corresponding second plurality of continuous streams of drops may charged negatively and deflected outwardly into a second guttering means by the single deflection field. Each of the one or more print-heads may also comprise an airflow duct. The airflow duct comprising at least the two deflection electrodes is operable for establishing a flow of air collinear with the jetting direction. The first row of nozzles may be arranged to emit the corresponding first plurality of continuous streams of drops into a first region of the flow of air with a first fluid drop velocity. The second row of nozzles may also be arranged to emit the corresponding second plurality of continuous streams of drops into a first region of the flow of air with a second fluid drop velocity. The electrostatic continuous inkjet printing apparatus may also include one or more systems controllers operable for matching the first fluid drop velocity with a first regional airflow velocity and the second fluid drop velocity with a second regional airflow velocity. The electrostatic continuous inkjet printing apparatus may also comprise a plurality of charging electrode drivers, each operable for producing a voltage waveform in accordance with one or more drop characterization signals. One or more systems controllers may be operable to produce the one or more drop characterization signals, in accordance with at least one of a print data stream and a guard drop scheme. The one or more print-heads may be arranged in a page-wide array.

In another aspect of the present invention, a planar charge electrode comprises a width $W_1$ extending in a direction substantially perpendicular to a corresponding continuous jet of fluid. The planar charge electrode is positioned by a distance $C_1$ to the corresponding continuous jet of fluid. The planar charge electrode is sized and positioned wherein $0.05\leqq C_1/W_1\leqq 0.75$, and more preferably, $0.05\leqq C_1/W_1\leqq 0.50$. The planar charge electrode may also comprise a length L, wherein $W_1\leqq L$. The planar charge electrode may also be openly curved along an axis parallel to the corresponding continuous jet of fluid.

In yet another aspect of the present invention, a method of charging drops comprises emitting at least one continuous jet of fluid along a jetting direction and stimulating the at least one continuous jet of fluid to form a corresponding at least one stream of fluid drops at a break-off point. The method further comprises charging at least one drop of the corresponding at least one stream of fluid drops with an associated planar charge electrode comprising a width $W_1$ extending in a direction substantially perpendicular to the jetting direction. The associated planar charge electrode is further positioned to one side of the at least one continuous jet of fluid and is positioned by a distance $C_1$ from the at least one drop, wherein:

$$0.05\leqq C_1/W_1\leqq 0.75, \text{ and more preferably, } 0.05\leqq C_1/W_1\leqq 0.50.$$

The at least one continuous jet of fluid may comprise at least a first and at least a second continuous jet of fluid and the method may further comprise emitting the at least a first continuous jet of fluid from a first row of nozzles, and emitting the at least a second continuous jet of fluid from a second row of nozzles. The method may further comprise offsetting the first row of nozzles from the second row of nozzles along a length of either row. The method may further comprise charging at least a first fluid drop corresponding to the at least a first continuous jet of fluid with a positive charge, and charging at least a second fluid drop corresponding to the at least a second continuous jet of fluid with a negative charge. The method may further comprise outwardly deflecting the at least a first fluid drop away from the second row of nozzles in a single deflection field and deflecting the at least a second fluid drop away from the first row of nozzles in a single deflection field, wherein the single deflection field is created by two deflection electrodes. The method may further comprise spacing the second row of nozzles apart from the first row of nozzles by a distance A, and establishing a spacing between the two deflection electrodes equal to a distance D, wherein D>A.

The method may further comprise establishing a flow of air substantially collinear with the jetting direction, wherein the flow of air comprises an airflow velocity profile with a maximum airflow velocity; a first region having a first regional airflow velocity lower than the maximum airflow velocity; and a second region having a second regional airflow velocity lower than the maximum airflow velocity. The method may further comprise emitting each of the corresponding at least one stream of fluid drops associated with the at least a first continuous jet of fluid into the first region with a first fluid drop velocity, and emitting each of the corresponding at least one stream of fluid drops associated with the at least a second continuous jet of fluid into the second region with a second fluid drop velocity. The method may further comprise substantially matching the first fluid drop velocity with the first regional airflow velocity, and the second fluid drop velocity with the second regional airflow velocity. The method may further comprise substantially matching the first fluid drop velocity with the second fluid drop velocity. The method may further comprise arranging the two deflection electrodes to establish substantially laminar airflow conditions within the flow of air.

Each of the nozzles in the first row of nozzles and the second row of nozzles may be regularly spaced with a nozzle-to-nozzle distance of 2B, and the method may further comprise spacing the second row of nozzles apart from the first row of nozzles by distance A, wherein A≧B/2. The method may further comprise establishing the spacing between the two deflection electrodes equal to the distance D, wherein D≦400 um. The method may further comprise charging the at least on drop of the corresponding stream of fluid drops in accordance with at least one of a print data stream and a guard drop scheme.

DETAILED DESCRIPTION OF THE INVENTION

Figure 1:
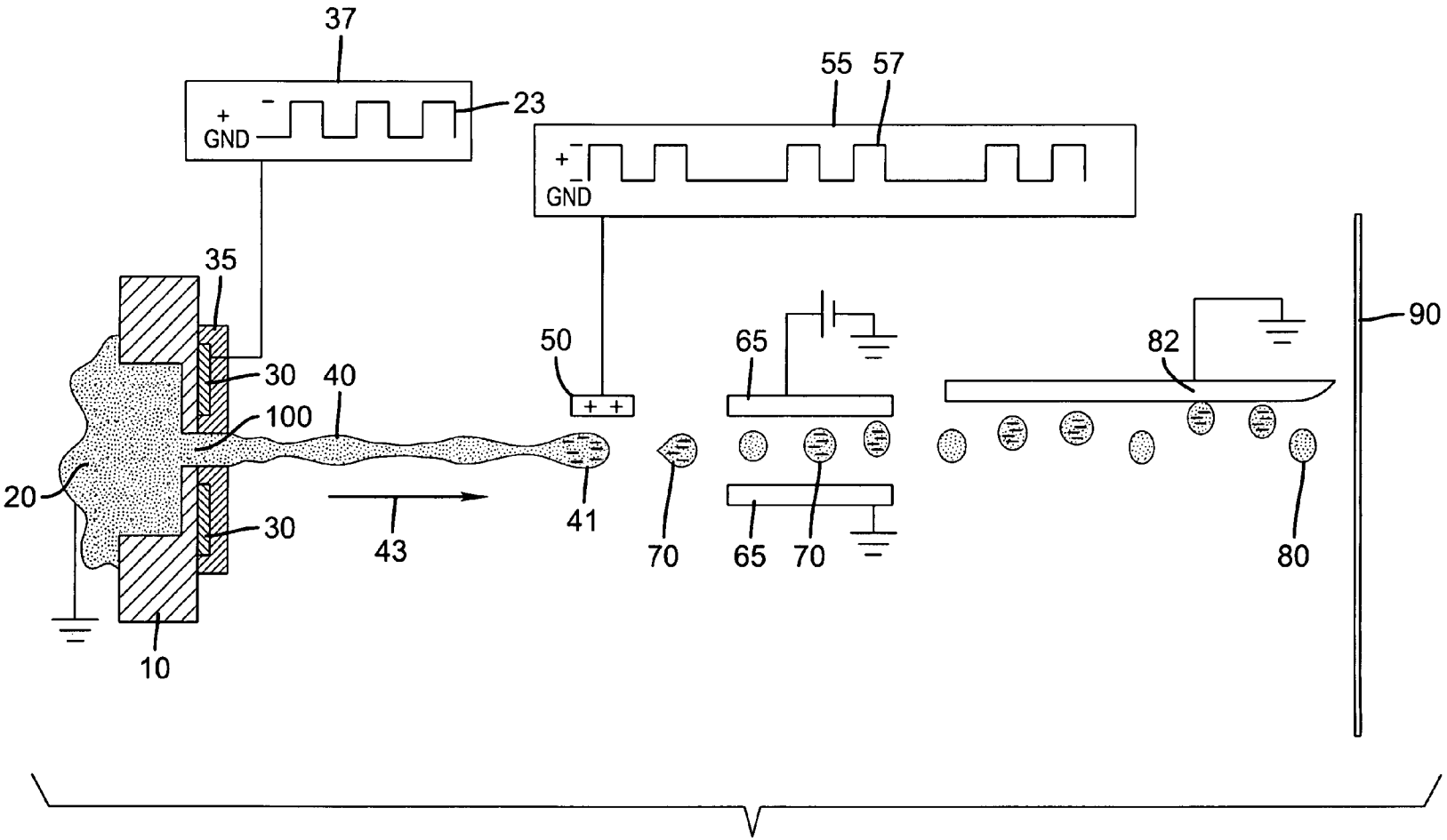
FIG. 1 PRIOR ART
FIG. 1 shows a prior art EHD print-head nozzle with drop characterization and deflection means.
Figure 1A:
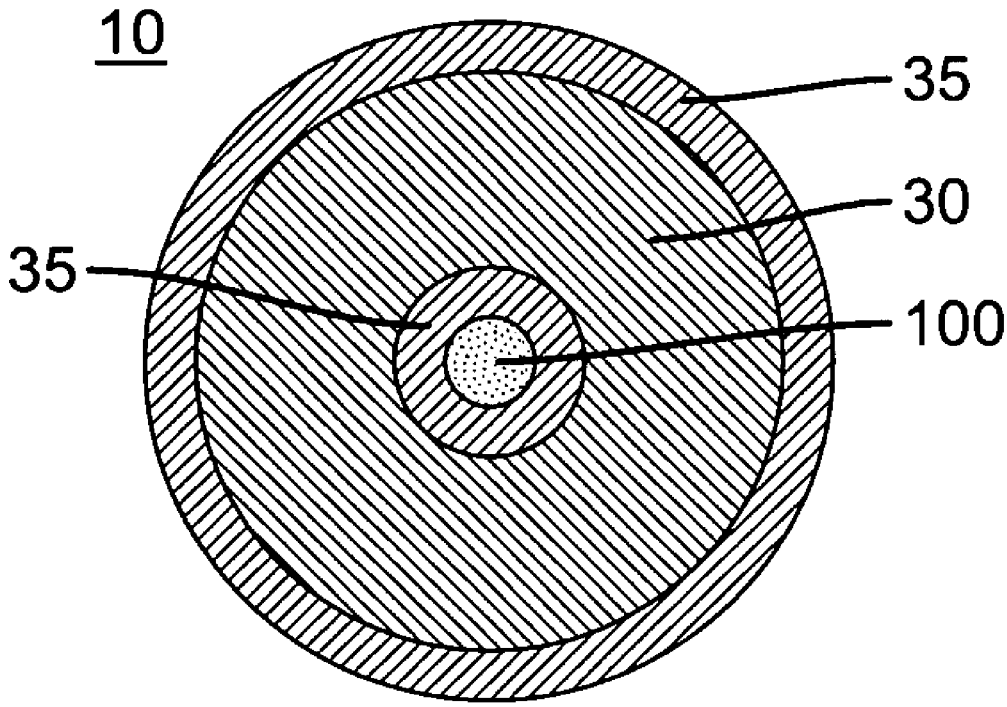
FIG. 1*a* shows a cross-sectional view of a stimulation electrode of the prior art EHD print-head nozzle shown in FIG. 1.

FIG. 1 shows a conventional prior art electrostatic continuous inkjet (CIJ) printer used to excite a continuous jet of conductive fluid into a stream of drops. Fluid manifold 10 contains conductive fluid 20 that is forced under pressure through nozzle 100 in the form of a jet 40 that is emitted in jetting direction 43. Conductive fluid 20 is grounded or otherwise connected through an electrical pathway. Jet 40 can be stimulated in a variety of ways to produce a corresponding stream of drops. These stimulation methods can include vibrating nozzle 100. Alternatively, a second stimulation method involves electrohydrodynamically (EHD) exciting jet 40 with an EHD exciter. A third technique, which has frequently been employed in the prior art, is to impose a pressure variation on the fluid in the nozzle 100 by means of a piezoelectric transducer placed typically within a cavity feeding the nozzle. In the prior art system shown in FIG. 1, an EHD stimulation electrode 30 is employed. EHD stimulation electrode 30 is a common electrode concentric with the nozzle and is shown in cross-section in FIG. 1*a*. EHD stimulation electrode 30 can be constructed by a variety of means including a surface metallization layer, or from a layer or layers of a semiconductor substrate at different doping levels to produce a conductive path. EHD stimulation electrode 30 is electrically connected to a stimulation signal driver 37 that produces a waveform of chosen voltage amplitude, period and functional relationship with respect to time. This waveform is produced in accordance with an electrical stimulation signal. In FIG. 1, an exemplary electrical stimulation signal 23 comprises a uni-polar square wave with a 50% duty cycle. The electrohydrodynamic stimulation is a function of the field strength squared at the surface of the conductive fluid 20 near nozzle 100 that induces charge in the jet and creates pressure variations along the jet 40. EHD stimulation electrode 30 is covered by one or more insulating layers 35 that isolate the EHD stimulation electrode 30 from conductive fluid 20 in order to prevent field collapse, excessive current draw and resistive heating of conductive fluid 20. The conductivity levels of conductive fluid 20 are sufficient to permit the induction of sufficient charge on any of the drops that are formed from the stimulation of jet 40. The charging of the drops in conventional prior art CIJ systems allows the formed drops to be characterized. That is, the conductive fluids permit charges of varying levels and polarities to be selectively induced on the drops such that they can be characterized for different purposes. Such purposes can include selectively characterizing each of the drops to be used for printing or to not be used for printing.

The EHD stimulation effect occurs due to the momentary induction of charge in conductive fluid 20 near the nozzle 100 by the stimulation electrode 30. The attraction of this charge to the stimulation electrode 30 then creates the pressure variation in the jet 40. For a correctly chosen frequency of the stimulation signal driver 37, the perturbation arising from the pressure variations will grow on the jet 40 until break off occurs at a break-off point 41. A charge electrode 50 is connected to charge electrode driver 55. The charge electrode 50 is driven by a time varying voltage waveform. The resulting potential attracts unbalanced charge through conductive fluid 20 to the end of the jet 40 where it becomes locked-in or captured on drops 70 once they break-off from the break-off point 41 of jet 40.

The voltage waveform produced by the charging electrode driver 55 will determine how the formed drops will be characterized. That is, the voltage waveform will determine which of the formed drops will be selected for printing and which of the formed drops will not be selected for printing. Drops in this example are characterized by "charging" as shown by charged drops 70 and uncharged drops 80. These drops will be characterized as "print-selected" drops or "non-printing" drops in accordance with the charge imparted on each drop by charge electrode 50 and the voltage waveform. The voltage waveform is produced in accordance with a drop characterization signal 57 applied to charging electrode driver 55. One or more systems controllers are used create and provide drop characterization signal 57. The drop characterization signal 57 comprises a waveform that is structured at least in part, in accordance with a print data stream that provides the droplet placement instructions required to successfully record a desired image. The print-data stream typically comprises instructions on which of the specific drops within the continuous stream of drops are selected for printing, or are not selected for printing. The drop characterization signal 57 will vary in accordance with the image content of the specific image to be produced. The drop characterization signal 57 can be also based at least in part by methods or schemes employed to improve various printing quality aspects such as the placement accuracy of drops selected to be printed. Guard drop schemes are an example of these methods. Guard drop schemes typically define a regular repeating pattern of drops within the continuous stream of drops. "Print-selectable" drops within the regular repeating pattern are drops that can be selected to print with if required by the print-data stream. Print-selectable drops selected to be printed with are thus subsequently characterized by a charge electrode to become "print-selected" drops. The pattern is additionally arranged such that guard drops (i.e. drops that cannot be printed with regardless of the print-data stream which are also referred to as non-print selectable drops) separate the print-selectable drops. This is done so as to minimize unwanted electrostatic field effects between the successive print-selectable drops and thus improve the placement accuracy of the print-selectable drops chosen for printing. These guard drop schemes can be programmed into one or more systems controllers and will therefore help alter the drop characterization signal 57 so as to define the print-selectable drops. It is understood by practitioners in the art that when a CIJ printer may comprise a plurality of nozzles, each of which emits a corresponding drop stream, and each drop stream has a corresponding charge electrode to characterize all of the drops within that drop stream.

Electrostatic deflection electrodes 65 placed near the trajectory of the drops interact with charged drops 10 by steering them according to their charge and the electric field created between deflection electrodes 65. Charged drops 70 that are deflected by deflection electrodes 65 may be collected on a gutter 82 while uncharged drops 80 may pass through and be deposited on a recording medium 90. In other prior art systems, this situation may be reversed with the deflected charged drops being deposited on the recording medium 90.

A high-resolution electrostatic continuous inkjet (CIJ) print-head system can require many hundreds or thousands of closely spaced nozzles of the type shown in FIG. 1. As used herein, the term "electrostatic" continuous inkjet (also known as electrostatic CIJ) print-head refers to a continuous inkjet print-head wherein an electrostatic charging of drops and an associated electrostatic deflection of said charged drops is used to differentiate between printing and non-printing drops. Additionally, the term "high-resolution" refers to an effective native drop generator spacing on the order of 500 dpi (dots/inch) or greater.

Small, closely spaced nozzle channels, with highly consistent geometry and placement can be constructed using micro-machining or micro-electro-mechanical (MEMs) fabrication technologies such as those found in the semiconductor industry. Typically, nozzle channel plates produced with these techniques are made from materials such as silicon and other materials commonly employed in semiconductor manufacture. Further, multi-layer combinations of materials can be employed with different functional properties including electrical conductivity. Micro-machining technologies include etching through the nozzle channel plate substrate to produce the nozzle channels. These etching techniques can include one of, or a combination of, wet chemical, inert plasma or chemically reactive plasma etching processes. The materials employed to produce the nozzle channel plates can have particular etching properties that make them suitable for a particular etching process or that can control the etching rate and the etch profile. The micro-machining methods employed to produce the nozzle channel plates can also be used to produce other structures in the print head. These other structures may include ink feed channels and ink reservoirs. Thus, an array of nozzle channels may be formed by etching through the surface of a substrate into a large recess or reservoir which itself is formed by etching from the other side of the substrate.

Problems arise in building of a native 500 dpi (or higher resolution) array because of mechanical considerations and because of electrostatic crosstalk effects arising during drop generation at the nozzles. For instance, a native 600 dpi single row nozzle array has nozzle-to-nozzle separations of approximately 42.5 um. There are several problems associated with this narrow spacing in a single row array. When smaller than 300 dpi separations are sought, mechanical limitations exist with the fabrication and alignment procedures used to produce structures such as the planar charge electrodes and in particular the electrical interconnects to the charge drivers. An electrostatic continuous inkjet print-head typically comprises a plurality nozzles and each of the nozzles has a corresponding planar charge electrode. The resulting plurality of planar charge electrodes are usually made from a plurality of conductive structures that are formed on a charge plate substrate that is offset from an array of corresponding nozzles. Each of the conductive structures of the planar charge electrodes is independently charged in accordance with desired charging requirements of the drops produced from the corresponding nozzles. As used herein, the term "planar charge electrode" refers to a charge electrode that is offset to one side of a jet emitted from a corresponding nozzle. Preferably, each of a plurality of planar charge electrodes comprises a substantially planar and open charge surface to facilitate their manufacture by industry standard thin film techniques. It is understood that other appropriate methods of manufacture as known in the art are not precluded from producing planar charge electrodes. Additionally, other preferred embodiments of the invention may employ a planar charge electrode that has an open and curved charge surface that is offset from, and partially encloses a jet from a corresponding nozzle. Such "curved shaped" planar charge electrodes could include partial U-shaped or V-shaped forms or any open shape so long as they are offset to one side of the jet. Such "curved shaped" planar charge electrodes may provide slightly better capacitive coupling and lower crosstalk effects, but at a cost of more difficult manufacturing and alignment requirements. The width, position and alignment of each planar charge electrode must be controlled to great accuracy on the charge plate itself and between the charge plate and the nozzle array. At 500 dpi resolutions, control of these factors is even more important and difficult to achieve.

Figure 2:
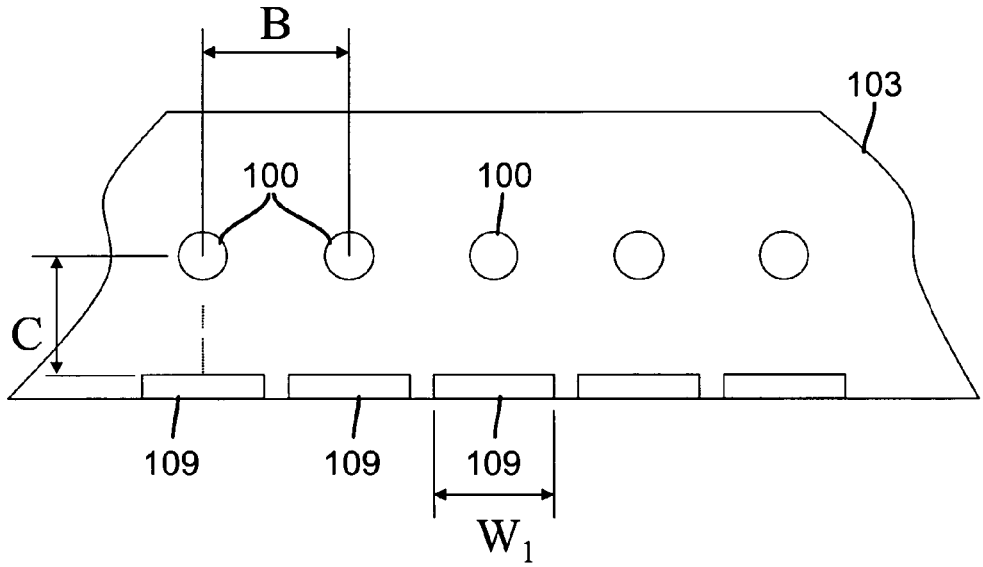
FIG. 2 shows a possible configuration for a high-resolution nozzle array.

FIG. 2 shows a 600 dpi single row nozzle array along with its associated set of planar charge electrodes. Again, as previously discussed, planar charge electrodes are preferred for use in a high-resolution electrostatic CIJ print-head. At a 600 dpi resolution, the maximum width of the planar charge electrodes is only 42.5 um minus a minimum required isolation gap between them. As shown in FIG. 2, an example of any array comprising a single row of nozzles 100 is formed in a substrate 103, with nozzle center-to-center separation of B. Planar charge electrodes 109 (shown in relative position in the plane of the array) are located adjacent each nozzle 100 and preferably centered on those nozzles with width $W_a$. Width $W_a$ is preferably oriented such that it extends in a direction substantially perpendicular to the jetting direction of the fluid jets emitted from nozzles 100. It should be noted that planar charge electrodes 109 are not typically formed on substrate 103, but rather, are formed on another substrate to produce the charge plate. Planar charge electrodes 109 are preferably positioned and aligned adjacent to break-off point 41 of each corresponding jet 40, wherein drops are formed and charged as required.

The amount of charge induced on the formed drops is a function of the capacitive coupling ability of the planar charge electrode 109. The final charge induced on a drop is a product of the voltage applied to the planar charge electrode 109 and its capacitance. A high capacitive coupling ability is desired in a planar charge electrode so as to consistently induce as high a charge level as possible on the formed drops. Highly charged drops gutter more quickly. This allows for a shorter print-head length that ultimately leads to better print quality. In this context, print-head length refers to the length of the print-head required for the various drops to travel through a downstream deflection field and be reliably guttered and reliably printed as their charge state dictates.

The capacitive coupling of each planar charge electrode 109 to its respective drop formed at break-off, is a function of the geometry of the planar charge electrode 109 and its spatial arrangement with respect to the jets 40 emitted by nozzles 100. The capacitive coupling is dependant on the width $W_a$ and length (not shown) of the planar charge electrodes 109 and increases with increasing electrode extent. The capacitive coupling is also dependent on the distance C from a planar charge electrode 109 to an adjacent jet 40 emitted by its respective nozzle 100 and increases with decreasing C. The width $W_a$ of planar charge electrode 109 is clearly limited by the spacing of the nozzles to be less than B. At a 42.5 um nozzle-to-nozzle spacing (i.e. 600 dpi), this arrangement limits the charge coupling (for a given practical electrode-to-jet spacing distance C, and thereby limits the amount of charge that can be induced on a separating drop. Insufficient drop charging is problematic since this condition requires either stronger deflection fields or a longer print-head length in order to gutter the charged drops carrying lesser charge.

Figure 3:
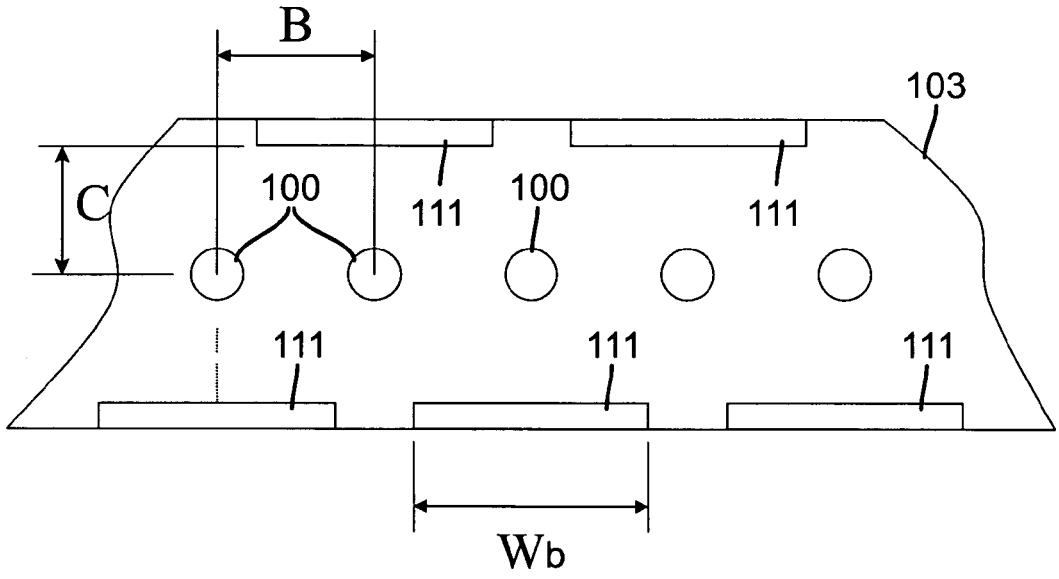
FIG. 3 shows yet another a possible implementation of a high-resolution nozzle array.

One potential solution to this problem is to build a charge plate in which the planar charge electrodes correspond to opposite sides of the nozzle array and every second planar charge electrode alternates on the opposite side of the array. Such a construction is shown in FIG. 3. In FIG. 3, planar charge electrodes 111 are positioned with respect to alternating sides of the array of nozzles 100. Again, planar charge electrodes would be typically produced on a separate charge plate substrate. This construction helps reduce the mechanical alignment tolerances to a degree that is more readily achievable and improves the charge coupling by allowing the planar charge electrode widths $W_b$ to be more than twice as wide as they could be on a single side of the nozzle array. Accordingly, widths $W_b$ can be made slightly less than the distance 2B, wherein B is again the nozzle-to-nozzle spacing. The widths of planar charge electrode 111 are more than twice the width available to the construction shown in FIG. 2. Width $W_b$ is also preferably oriented such that it extends in a direction substantially perpendicular to the jetting direction of the fluid jets emitted from nozzles 100. Further, the planar charge electrode spacing shown in FIG. 3 has a spatial density less than half of that shown in FIG. 2 and therefore additionally reduces the interconnect density and simplifies the electrical connection requirements.

Another problem with the described print-head arrays shown in FIG. 2 and FIG. 3 is that of influence charging. Influence charging can occur when the charging of a particular jet is affected by the charging of a directly adjacent jet. The directly adjacent jet may be on the same row of nozzles or between a pair of rows of nozzles if a multi-row printer is employed. Influence charging is very likely when high-resolutions (i.e. 500 dpi or greater) are required. At these high resolutions, the potential state on any particular planar charge electrode 109 will significantly affect the charging of neighboring drops formed from jets emitted from neighboring nozzles 100.

The construction shown in FIG. 3, while having improved capacitive coupling over the construction in FIG. 2, is still problematic in that that the influence charging that any given charge planar electrode 111 has on any of the jets emitted from neighboring nozzles 100 is very large and in fact larger than the construction of FIG. 2 due to the close physical proximity of the ends of the neighboring charge electrodes on the other side of a given jet.

Figure 4:
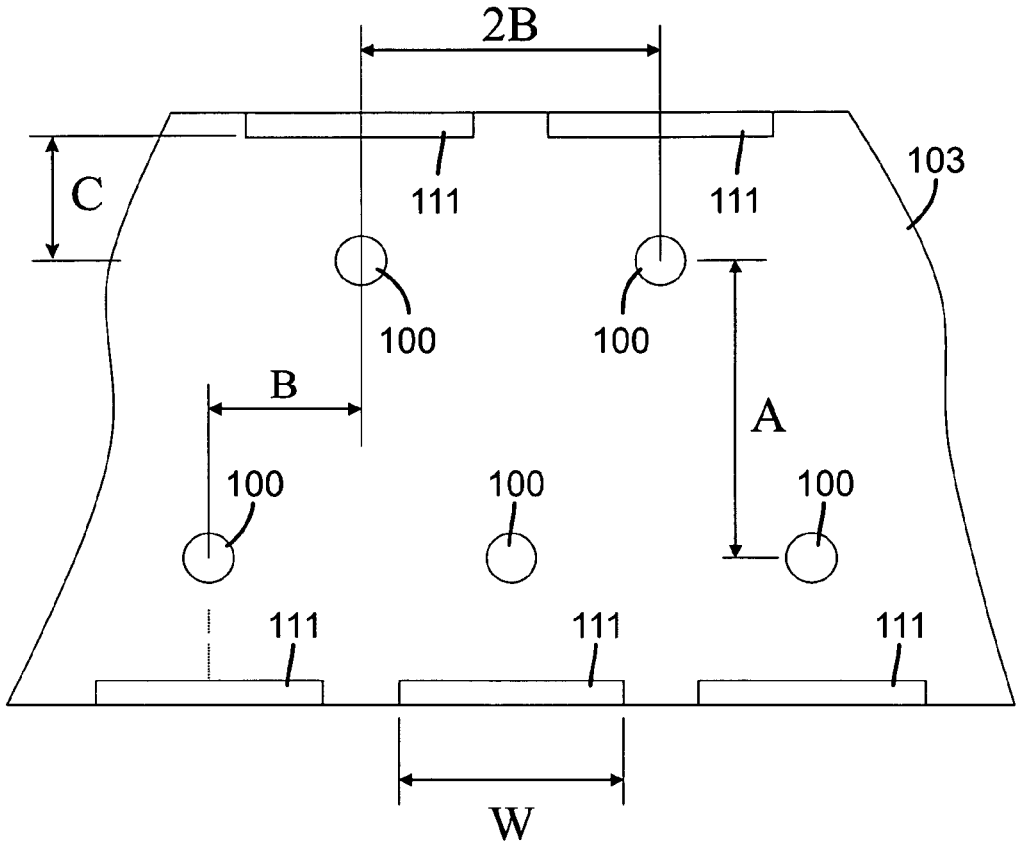
FIG. 4 shows a high-resolution nozzle array as per a preferred embodiment of the present invention.

A solution to achieving the aforementioned coupling advantage and to reduce the remaining influence charging problem is to then separate the nozzles formed into substrate 103. Specifically, instead of using a single row with a high-resolution nozzle-to-nozzle spacing, an array comprising 2 rows of nozzles is used. In this dual row construction, each of the nozzle rows has a nozzle-to-nozzle spacing equal to half of the nozzle-to-nozzle spacing employed in the single row construction. FIG. 4 shows a preferred embodiment of the invention comprising this dual row construction. The resulting two rows of nozzles, each comprising a nozzle-to-nozzle spacing equal to 2B, are separated from each other by an inter-row spacing A. Each row is offset from the other in the direction of the length of either row, by an amount equal to distance B, thus providing an "effective" total nozzle-to nozzle separation equal to B in the direction parallel to the array length. Offsetting the two rows from each other by distance B advantageously allows for a high native print-head resolution to be achieved with rows that each comprise a nozzle-to-nozzle spacing corresponding to half of the desired high-resolution. Further, in a preferred embodiment of the invention in which spacing B is 42.5 (i.e. 600 dpi), adjustment of inter-row spacing A need only be of the order of B to reduce nearest neighbor influence to within a limit approaching that of two widely separate 300 dpi rows. Wide planar charge electrodes 111 with width W<2B are possible at each nozzle permitting good capacitive coupling to the jet for strong charging of the separating drops. Mechanical alignment tolerances of the planar charge electrodes 111 to the nozzles 100 are relaxed as these are built and aligned at the larger spacing of 2B. Planar charge electrodes 111 are typically formed on a separate charge plate substrate. The width W of each of the planar charge electrodes 111 preferably extends in a direction substantially perpendicular to the jetting direction of the fluid jets emitted from nozzles 100. It is understood that some misalignment is permissible from this orientation without detracting from the benefits of the present invention. If planar charge electrode 111 is skewed with respect to the jetting direction, a portion of the planar charge electrode will have an "effective" width W that is substantially perpendicular to the jetting direction as described in the present invention. Alignment between the nozzles in the displaced rows formed in substrate 103 can be obtained to very high degree by using MEMS construction techniques to fabricate the two separated rows on a single substrate. Likewise, the plurality of corresponding planar charge electrodes 111 can also be produced on a charge plate substrate with the same degree of accuracy and with the same MEMs techniques.

Planar charge electrode-to-jet spacing C is chosen to keep the ratio of the distance C to the planar charge electrode width W preferably less than 0.75, and more preferably, under 0.50, thus permitting high capacitive coupling to the intended jet and reduced nearest neighbor electrostatic influence. The reason for this is that the capacitive coupling to a given jet increases as the width of a corresponding planar charge electrode is increased. Once again, capacitive coupling is a measure of the charge induced at the end of a given jet for a given voltage applied to a corresponding charge electrode. Similarly, the capacitive coupling increases as the planar charge electrode-to-jet spacing C is decreased. In addition, the electrostatic influence charging that a given jet undergoes due to neighboring planar charge electrodes decreases as the width W of the planar charge electrode is increased. This influence charging also decreases as the planar charge electrode-to-jet spacing C is decreased. It should be noted that the length of the planar charge electrode L (i.e. the length being along the jet direction) will not affect these favorable capacitive coupling and influence charging conditions, so long as the length of the planar charge electrode is substantially longer than its width. The capacitance of the planar charge electrode to the drop breaking off rapidly approaches the "infinite" limit of the electrode once the ratio of L/C exceeds 1. In a preferred embodiment of the invention, the planar charge electrode widths W and the planar charge electrode-to-jet spacing is selected such that: W<2B, the nozzle-to-nozzle spacing, $0.05 \leqq C/W \leqq 0.75$ and preferably, $0.05 \leqq C/W \leqq 0.50$.

It should be noted that planar charge electrode width W will be limited by the array resolution and the minimum manufacturable spacing between adjacent planar charge electrodes, but as shown above, may be increased by more than a factor of 2 by going to a second row of charge electrodes. Planar charge electrode-to-jet distance C is limited by such factors as ink misting, jet pointing accuracy, alignment, drop diameter, and thus cannot be made arbitrarily small. In addition to reducing influence charging and increasing charge coupling, a small C also reduces drop-to-drop influences.

Figure 5:
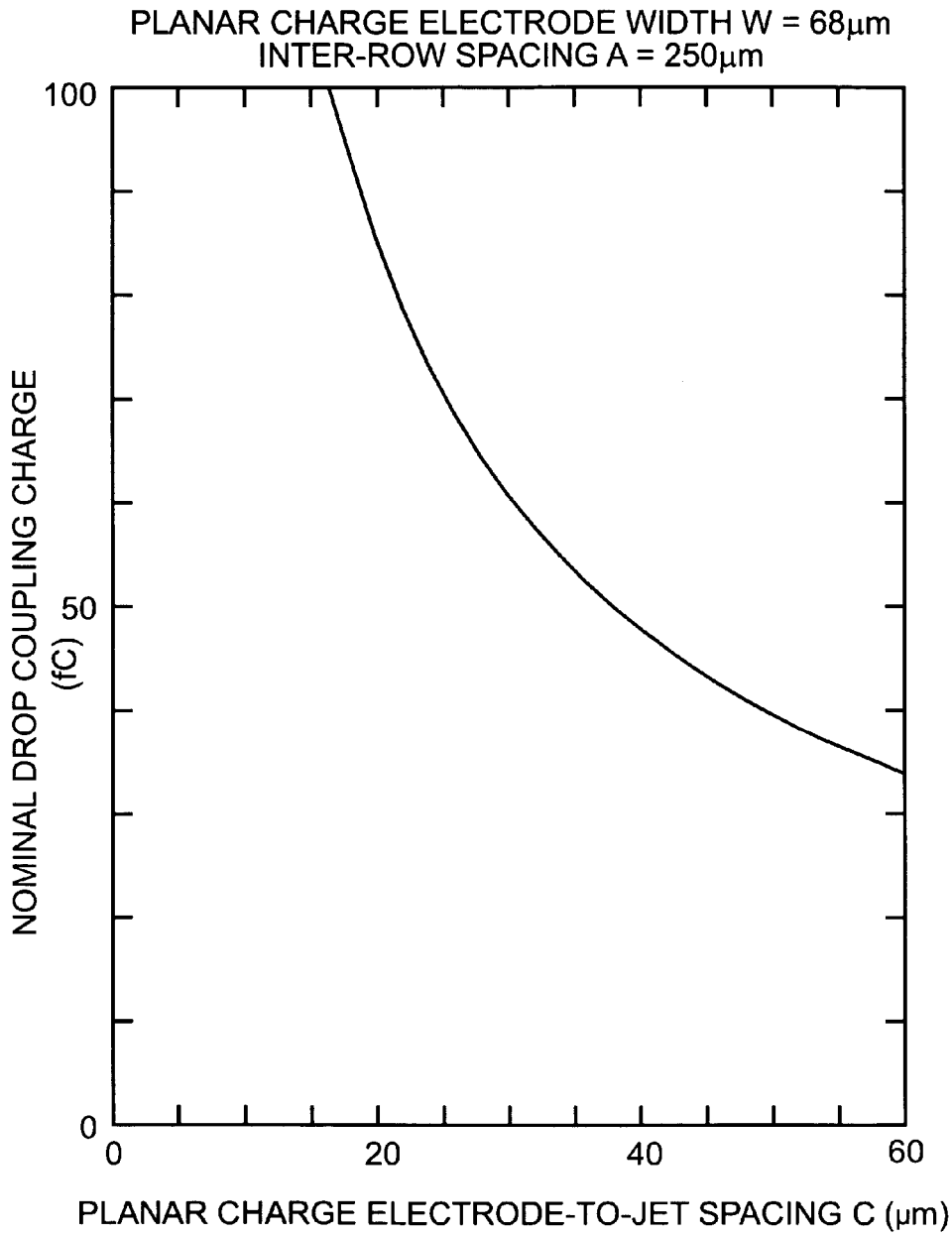
FIG. 5 shows a graph simulating charge coupling as a function of planar charge electrode-to-jet spacing according to a preferred embodiment of the invention.

FIG. 5 shows a graph simulating the affect on charge coupling as a function of planar charge electrode-to-jet spacing C for a preferred embodiment of the invention comprising a dual, offset row print-head with an effective 600 dpi resolution, an inter-row spacing A equal to 250 um and a planar charge electrode width W equal to 68 um. Approximately a 170% increase in charging efficiency can be expected when a planar charge electrode-to-jet spacing C of 30 um (i.e. C/W=0.44) is chosen over a planar charge electrode-to-jet spacing C of 60 um (i.e. C/W=0.88).

Figure 6:
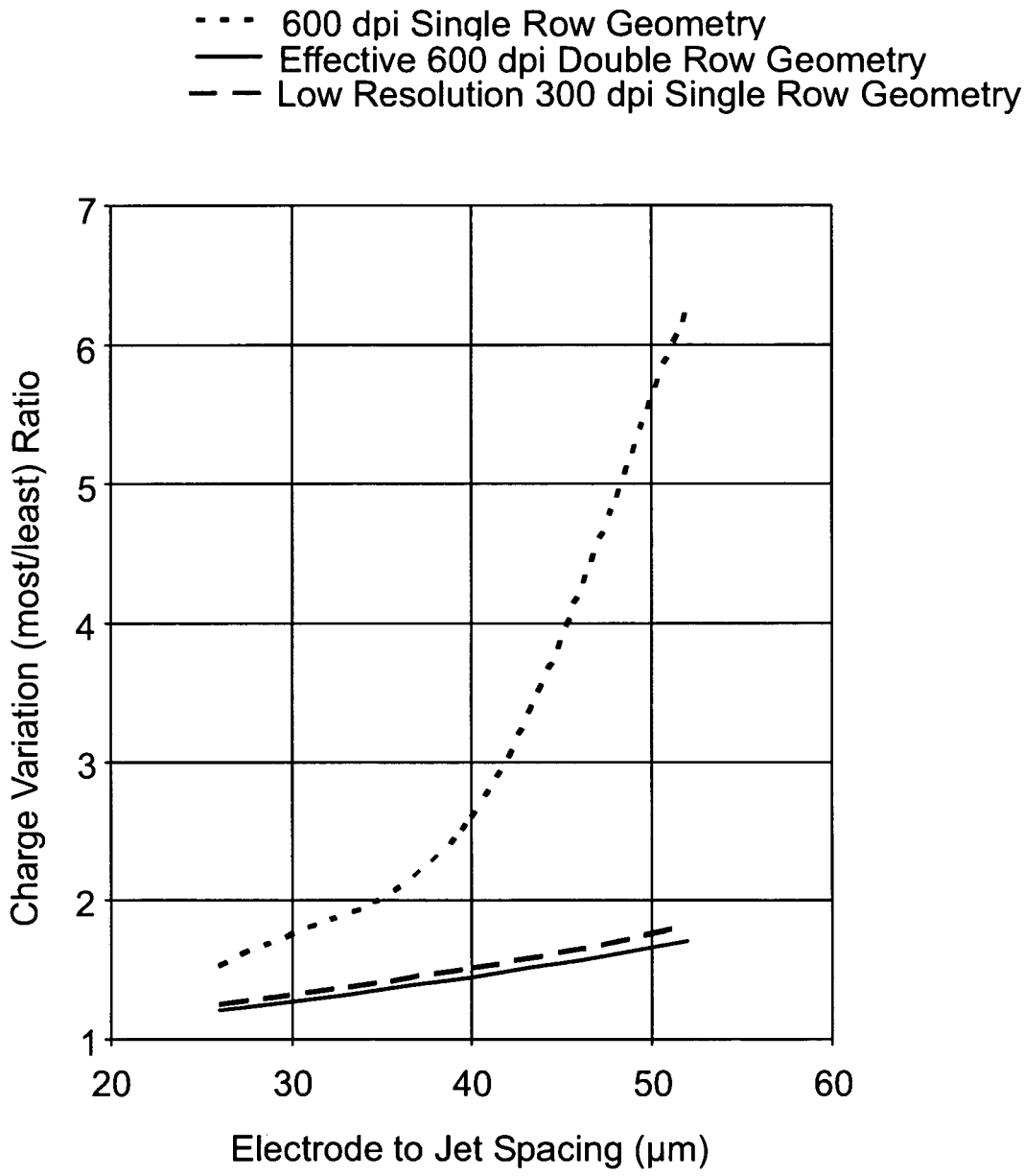
FIG. 6 shows a graph simulating charge variation ratio as a function of electrode-to-jet spacing for various print-heads, including a print-head as per a preferred embodiment of the invention.

The improved capacitive coupling and influence charging benefits provided by a preferred embodiment of the invention as shown in FIG. 4 can be further shown in an exemplary manner by a comparison graph shown in FIG. 6. The graph shown in FIG. 6 simulates the range of variations in drop charge levels between the following exemplary print-heads: a 600 dpi single row geometry as shown in FIG. 2; an effective 600 dpi double row geometry (i.e. two offset 300 dpi rows) with an inter-row spacing, A=160 um, as shown by a preferred embodiment of the invention in FIG. 4; and a relatively low resolution 300 dpi single row geometry as shown in FIG. 2 with dimensions set accordingly.

The simulation includes only influence charging and not drop-to-drop influences. The three separate curves in the graph shown in FIG. 6 respectively show the range of charge variations ratios as a function of electrode to jet spacing C for each of the three exemplary print-heads. The ordinate of the graph shown in FIG. 6 represents the ratio of drop charge levels as generated in two distinct cases during the operation of the three different print-heads. In the first case, all the jets in all rows of each print-head are charged at a potential necessary for guttering the drops. In the second case, every second jet in each row of each of the print-heads is charged at this "guttering" potential, while the remaining (alternate) jets are charged with a potential of sign and magnitude as required to cancel the influence from the neighboring electrodes so that the drop charge is substantially zero. In these two cases it is to be understood that when a particular jet is charged with a guttering potential, its corresponding planar electrode is driven to provide this charge. Likewise, when a particular jet is charged with a "printing" potential, its corresponding planar charge electrode is driven with a very low, or substantially zero voltage. Alternatively, this "printing" potential can comprise a suitably chosen influence canceling voltage. The graphed ratio between the drop charge levels that result from these two distinct cases demonstrates the extent of the charge levels that are imparted on drops selected to be charged and guttered. Specifically this ratio compares guttered drop charge levels when no drops are being printed and when half of the drops are being printed with. Clearly, the first case is considered an extreme case. The second case however is also an extreme case since it corresponds to a maximum print rate dictated by a print-head in which a guard drop scheme is employed. Specifically, the alternate drop charging scheme described in the second case occurs when a 1:2 or 1:4 guard drop scheme is employed in each row of nozzles. Again, guards drop schemes are employed to position guard drops (charged drops in this case) between drops that can be printed with (non-charged drops). Guard drop schemes are advantageously employed to further reduce undesired electrostatic crosstalk effects between print drops. Guard drop schemes are described in more detail below. It is noted that values for the ratio are always greater than 1, since the charges found on each of the charged drops are greatest when all the planar charge electrodes are driven at guttering potential levels.

The abscissa of the graph shown in FIG. 6 is the planar charge electrode-to-jet spacing C. The value of C varies from between 26 um and 52 um. In all three print-heads, the gap (along the array) between each of the planar charge electrodes is fixed at 20 um and the planar charge electrodes width are adjusted accordingly to the print resolution required by each of the rows of nozzles in each print-head. In the case of the 600 dpi dual row print-head of a preferred embodiment of the invention, the planar charge electrode width is 65 um and the C/W ratio is varied from 0.4 to 0.8. For the single row 600 dpi case the electrode width is by necessity much smaller and the C/W ratio starts at a value near 1 at the left side of the graph in FIG. 6 and increases from there. Clearly for values of C/W>1 the charge ratio of the two extreme cases considered rapidly gets large.

As previously described, it is desirable to minimize the range of charge variation on the charged drops in order to ensure a minimal range of landing zones on a gutter. Minimizing this range reduces the overall gutter length permitting the use of the shortest head structure possible. Short heads have inherently higher print quality due to reduced drop placement errors.

It is readily seen from FIG. 6 that the single row 600 dpi print-head has the greatest range of charge ratio Specifically this print-head has a charge variation ratio that varies from more than 1.5 to over 6 across the range of electrode to jet spacings of interest. Clearly, this charge variation ratio worsens as the planar charge electrode-to-jet distance C increases. Even at the smallest distance C, which would be near the limit of operational alignment tolerances for the gap between the planar charge electrode and the jet, the range of more than 1.5 is starting to be problematic in terms of controlling guttering to a reasonable landing range. The graph shown in FIG. 6 also shows that the charge variation range for the 600 dpi dual row print-head of a preferred embodiment of the invention is much lower than that of the single row 600 dpi print-head, and in fact is very similar at the 160 um row spacing, to the low resolution 300 dpi single row print-head.

The data indicates that a 600 dpi single row with electrostatic charge characterization is impractical. However, a preferred embodiment of the invention incorporating a dual row 600 dpi array with a properly chosen C/W ratio reduces drop charge variation to a manageable level.

Figure 7:
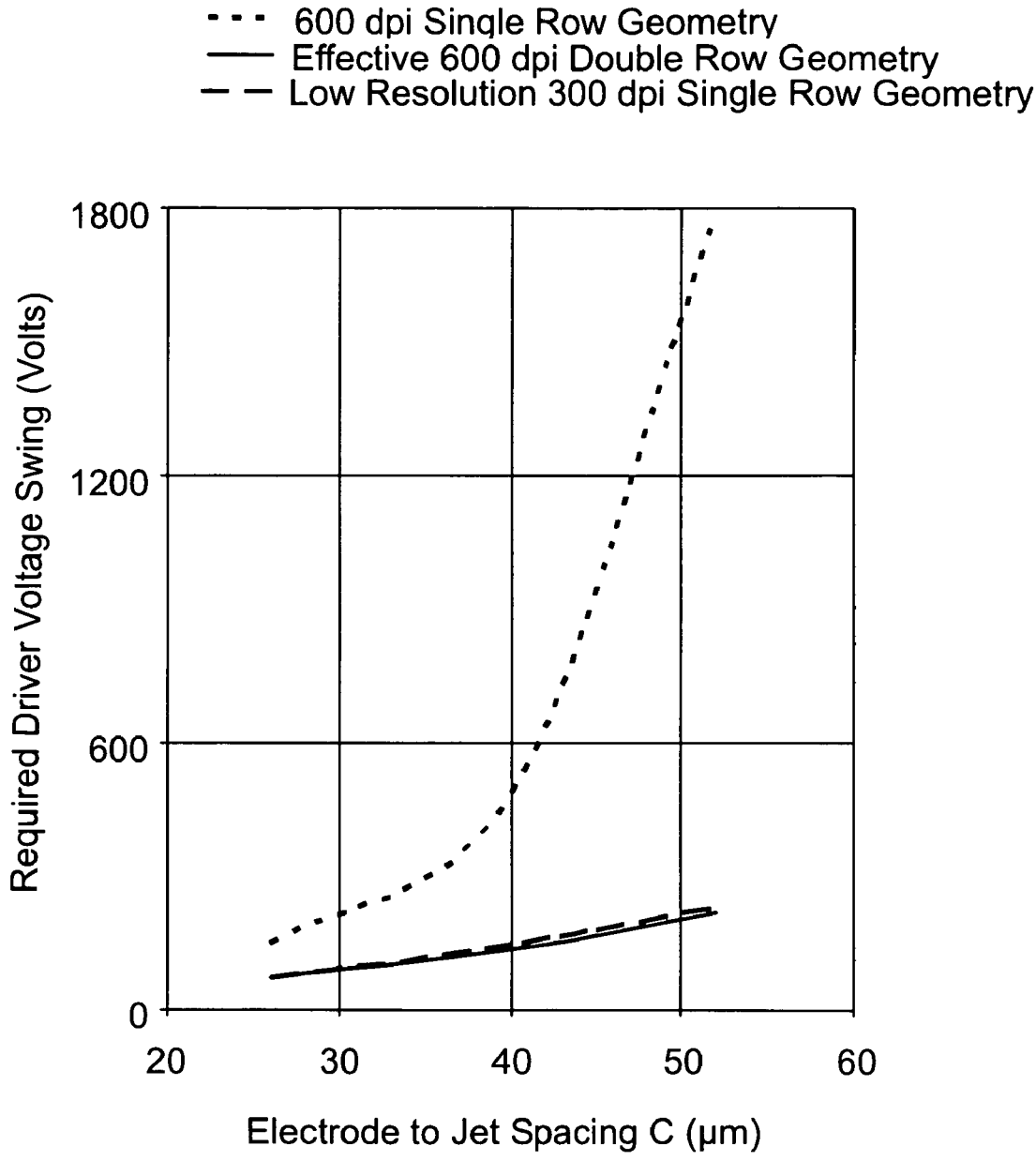
FIG. 7 shows a graph simulating required driver voltage swing as a function of electrode-to-jet spacing for various print-heads, including a print-head as per a preferred embodiment of the invention.

FIG. 7 shows a graph that simulates the range of required driver voltage variation or "voltage swing" as a function of electrode to jet spacing that is needed to drive the planar charge electrodes to charge drops with a guttering charge (50 fC) and to drive alternate planar charge electrodes in order to charge drops with a printing charge comprising substantially zero charge. This simulation includes only influence charging effects. A single power supply operating between the two required voltages is the most cost effective means to drive the planar charge electrodes in an array with hundreds or thousands of nozzles. The power supply must also be switched at a very high rate required by the data rate of each individual nozzle in the print-head. This switching of multiple channels, or planar charge electrodes, is performed by high voltage, high speed driver circuits. This requirement for a wide voltage range and high speed switching in a small package needed for a high-resolution printing device is costly. It is therefore beneficial to minimize the voltage range or swing at which the electrodes are operated.

FIG. 7 shows a graph in which three curves represent the range in voltage swing that would be expected from the three exemplary print-heads analyzed in the graph of FIG. 6. In the graph shown in FIG. 7, the ordinate represents the driver voltage swing required to switch between two separate states. In the first state, all the drops of all the rows of each print-head are charged as guttered drops. In the second state every second drop in each row of each print-head is charged as a guttered drop, the alternate remaining drops being charged as print drops with substantially no charge. This second state would occur when a 1:2 or 1:4 guard drop scheme is employed in each row of each print-head.

As in FIG. 6, the abscissa in FIG. 7 is planar charge electrode-to-jet distance C. The value of C varies from between 26 um and 52 um. In all three print-heads, the gap (along the array) between each of the planar charge electrodes is fixed at 20 um and the planar charge electrodes width are adjusted accordingly to the print resolution required by each of the rows of nozzles in each print-head. In the case of the 600 dpi dual row print-head of a preferred embodiment of the invention, the planar charge electrode width is 65 um and the C/W ratio is varied from 0.4 to 0.8. For the single row 600 dpi case the electrode width is by necessity much smaller and the C/W ratio starts at a value near 1 at the left side of the graph in FIG. 7 and increases from there. Clearly for values of C/W>1 the voltage swing required for the two extreme cases considered rapidly gets large.

As in FIG. 6, the three curves shown in the graph shown in FIG. 7 corresponds to the following three exemplary print-heads: a 600 dpi single row geometry as shown in FIG. 2; an effective 600 dpi double row geometry (i.e. two offset 300 dpi rows) with an inter-row spacing, A=160 um, as shown by a preferred embodiment of the invention in FIG. 4; and a relatively low resolution 300 dpi single row geometry as shown in FIG. 2 with dimensions set accordingly.

The curves indicate that values for the voltage swing can range from under 100 volts to nearly 1800 volts, the high end being impractical. It is readily seen from FIG. 7 that the single row 600 dpi structure has largest values of the driver voltage swing and that most of this voltage range is impractical for a high speed, high density device. The 600 dpi dual row structure of the preferred embodiment of the invention, demonstrates voltage swings under 100 volts when the planar charge electrode-to-jet distance can be kept to under 30 um. Thus, this preferred embodiment of the invention produces voltage swing variations that are comparable to those seen with the 300 dpi structure while permitting higher resolution printing.

Clearly, this preferred embodiment of the invention comprising two separated rows of nozzles offset in the direction of the nozzle array, can be used to produce a high-resolution electrostatic CIJ print-head in which the planar charge electrodes can be configured to maximize charge coupling. Additionally, such a print-head allows for a maximization of the distance between adjacent nozzles within a given row, and a corresponding reduction in undesired electrostatic influence charging by any adjacent and neighboring charge electrode on any given drop formed from a jet emitted by any given nozzle in any of the rows. This form of undesired electrostatic influence is also known as charge electrode-to-jet crosstalk or "nozzle-to-nozzle" crosstalk. It is readily apparent that this nozzle-to-nozzle crosstalk can also occur between adjacent nozzles within adjacent rows. Obviously, spacing the two rows of nozzles further apart will reduce nozzle-to-nozzle crosstalk between the rows. However, when a preferred embodiment of the invention as shown in FIG. 4 is employed, the inter-row spacing, A can be reduced significantly without a heavy penalty in inter-row nozzle-to-nozzle crosstalk, thus advantageously producing a more compact print head. The advantageous effects of a small inter-row spacing are described in more detail below.

Other preferred embodiments of the invention may employ similar print-head architectures that also enjoy the benefits of the present invention.

Other preferred embodiments of the invention can include a print-head comprising two rows of nozzles that are not offset from on another along the length of either row. In these preferred embodiments of the invention, the corresponding plurality of planar charge electrodes sized and positioned such that the C/W ratio is less than 0.75, and preferably less than 0.50. An effective "high" native resolution can be achieved with these embodiments of the invention by inclining the print-head at an appropriate angle to the desired direction of printing. Inclining the print-head so that it is not square to the direction of printing effectively allows the jets emitted by the first row of nozzles to be interlaced with the jets emitted by the second row of nozzles.

Other embodiments of the invention may include offsetting each of the rows of nozzles from one another by a distance less than half of the inter nozzle spacing in either of the rows. In these preferred embodiments of the invention, the jets emitted by the first row of nozzles can be interlaced with the jets emitted by the second row of nozzles by additionally inclining the print-head in the direction of printing by an angle appropriate to produce the native resolution desired with the particular row offsets. Typically, in these preferred embodiments of the invention, the required angles would be less than in embodiments of the invention wherein the two rows of the invention are not offset from one another.

In all embodiments of the present invention, the C/W ratio should be ratio is less than 0.75, and preferably less than 0.50 for each of the rows. The planar charge electrode-to-jet distance C and the planar charge electrode W may vary between the first and second rows but not in a manna that does not allow the appropriate C/W ratio to be maintained in each row. It should be noted that in these other embodiments of the invention in which the first and second rows are not offset from one another or are offset from one another by a distance less than half the nozzle-to-nozzle spacing in either row, influence charging may be marginally increased between adjacent nozzles in different tows. This may be mitigated by adjusting the inter-row spacing A.

If a single guttering means is employed, any inter-row spacing between the two rows of nozzles will increase the required trajectories of at least some of the charged drops that are to be subsequently guttered. These longer guttering trajectories in turn would require the print-head length to increase, which in turn magnifies any print drop placement errors and limits print quality. Preferred embodiments of the invention employ two separate guttering means preferably constructed on each side of the nozzle arrays such that each of the guttering means is adjacent to one of the rows of nozzles. The charged "gutter drops" in each row are subsequently deflected along a short trajectory to the nearest adjacent gutter, thus minimizing print-head length requirements.

Clearly, the above preferred embodiment of the invention needs a drop deflection means that is capable of deflecting gutter drops in opposite directions to the nozzle array. The prior art has described the use of a central conductive deflection electrode to create two separate deflection fields to deflect charged drops in opposing directions. However, because of the tight space constraints required by a high-resolution, high nozzle density print-head, it is disadvantageous to build structures such as a central conductive deflection electrode positioned between the two rows of nozzles. Additionally, such a central deflection electrode would likely and adversely require an increase in the inter-row spacing A. The presence of a central deflection electrode combined with a larger inter-row spacing could thus limit the adoption of a laminar and collinear airflow means used to minimize aerodynamic effects between the emitted drops. This laminar and collinear airflow means are described in more detail below.

Another preferred embodiment of the invention incorporates a single deflection field as the preferred means of deflecting charged gutter drops to opposite guttering means positioned on opposing sides of the print-head. The single deflection field is created by a pair of deflection electrodes positioned such that the streams of drops emitted by each of the two rows of nozzles travel between the two deflection electrodes. One of the two deflection electrodes will be charge with a positive or negative polarity whereas the other deflection electrode will be charged with an opposing polarity. It is to be noted that since the drops emitted by each of the two rows of nozzles are deflected in opposite directions to their nearest guttering means by this single common field, the guttered drops in each of the rows must be charged with opposite or bi-polar polarities. That is, in one of the two rows, gutter drops will be charged with a positive polarity whereas in the other row, gutter drops will be charged with a negative polarity. This preferred embodiment of the invention permits the shortest path of travel for all charged drops to the gutters and thereby permits the construction of a shorter head, with the benefit of better drop placement. This preferred embodiment does not require a central deflection electrode which would likely lead to a larger inter-row spacing requirement. In this preferred embodiment, the print drops that are to arrive at recording surface 90 are left substantially uncharged. Alternatively, the print drops may be charged with a charge opposite in polarity to that which would be required to gutter the drops to their respective gutter, but of a sufficient magnitude that would allow them to arrive at a more central location (i.e. between the two rows of nozzles) onto recording surface 90.

It should be noted that in preferred embodiments of the invention described, the voltages or potentials applied to each of the two deflection electrodes are of opposite polarity and preferably are of the same magnitude. This allows for a "symmetric" dual row print-head to be produced in which the drop streams emitted by each of the rows of nozzles are charged with a uniform charge levels so as to be uniformly deflected by the corresponding deflection field. Symmetric dual row print-heads are advantageous since equivalent charging means (polarity aside) can be employed for each of the two rows. When potentials of opposite polarity and differing magnitudes are applied to each of the deflection electrodes, a non-symmetric dual row print-head results. A non-symmetric dual row print-head requires different charging means (polarity aside) to apply differing charge magnitudes to drop streams emitted in each of the two rows. Other embodiments of the invention may comprise a non-symmetric print-head architecture if desired. A non-symmetric dual row print-head also results when one of the two deflection electrodes is grounded.

Figure 8:
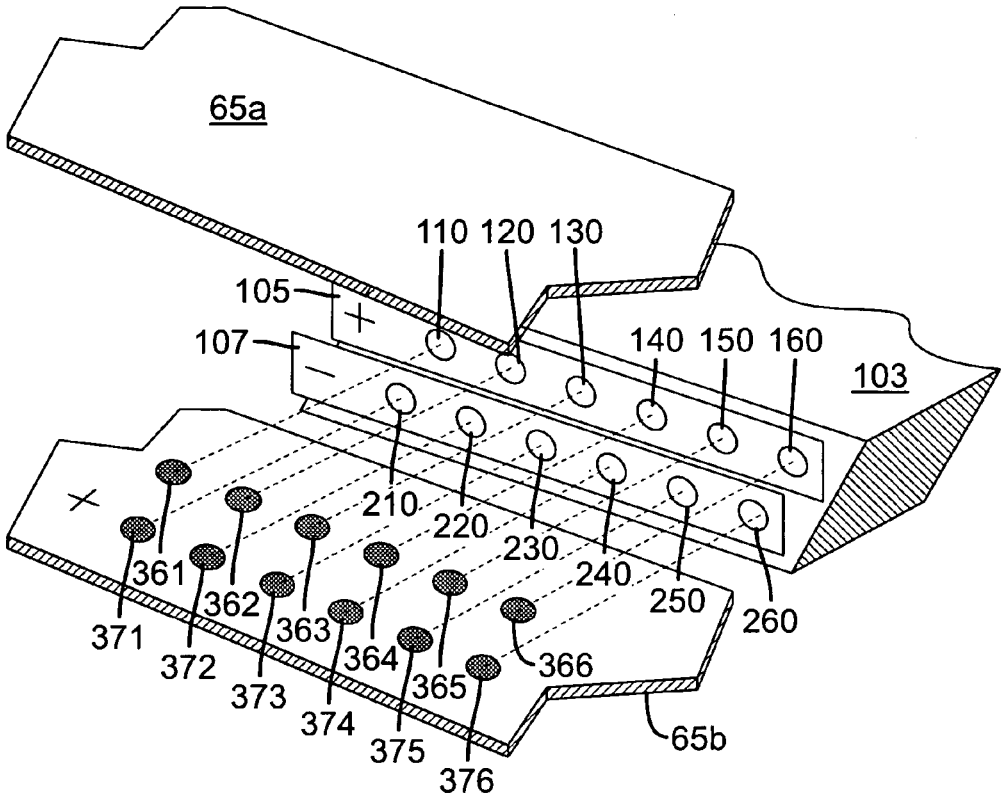
FIG. 8 shows a perspective view of 2 row nozzle array and deflection array as per a preferred embodiment of the invention.

FIG. 8 shows a preferred embodiment of the present invention. Linear inkjet nozzle array 105 is comprised of a first plurality of inkjet nozzles, of which nozzle 110, 120, 130, 140, 150 and 160 are chosen as representative examples for the purposes of explaining the present invention. Linear inkjet nozzle array 107 is comprised of a second plurality of nozzles, of which nozzles 210, 220, 230, 240, 250 and 260 are chosen as representative examples for the purposes of explaining the present invention. As described in a previous embodiment of the present invention, linear inkjet nozzle array 105 and linear inkjet nozzle array 107 are positioned parallel to each other and mutually shifted by half of the separation between adjacent nozzles within each of the linear inkjet nozzle arrays.

For the sake of clarity, the present invention shall be described at the hand of a preferred embodiment in which all nozzles on linear inkjet nozzle array 105 may generate either neutral or positively charged drops. Conversely, all the nozzles on linear inkjet nozzle array 107 may generate either neutral or negatively charged drops. The charge on a drop is made neutral when the drop is selected to print upon the recording surface 90 (not shown in FIG. 8). When a drop is selected for guttering, it is charged, the charge being positive for drops emanating from linear inkjet nozzle array 105 and negative for drops emanating from linear inkjet nozzle array 107. In this preferred embodiment of the invention, each jet is charged by a corresponding planar charge electrode (not shown in FIG. 8) that has been sized and positioned as previously described.

FIG. 8 shows the disposition of deflection electrodes 65*a* and 65*b* relative to the inkjet nozzle arrays. Nozzles 110 to 160 of linear inkjet nozzle array 105 produce drops 361 to 366. Nozzles 210 to 260 of linear inkjet nozzle array 107 produce drops 371 to 376. If one of these drops from linear inkjet nozzle array 105 were to be neutral, it would be allowed to pass through along its trajectory, but if it were charged (array 105 always being listed in the present embodiment to creating positively charged or neutral drops), the drop would be deflected towards deflection electrode 65*a*, which is negatively charged. If one of the drops from linear inkjet nozzle array 107 were to be neutral, it would be allowed to pass through along its trajectory, but if it were charged (array 107 always being limited in the present embodiment to creating negatively charged or neutral drops), the drop would be deflected towards deflection electrode 65*b*, which is positively charged. In this way, all drops emanating from inkjet nozzle arrays 105 and 107 are either allowed to pass along their trajectory towards recording surface 90 (not shown in FIG. 8) when neutral, or are deflected to a guttering system (also not shown) due to the electrostatic field between deflection electrodes 65*a* and 65*b*.

Figure 9:
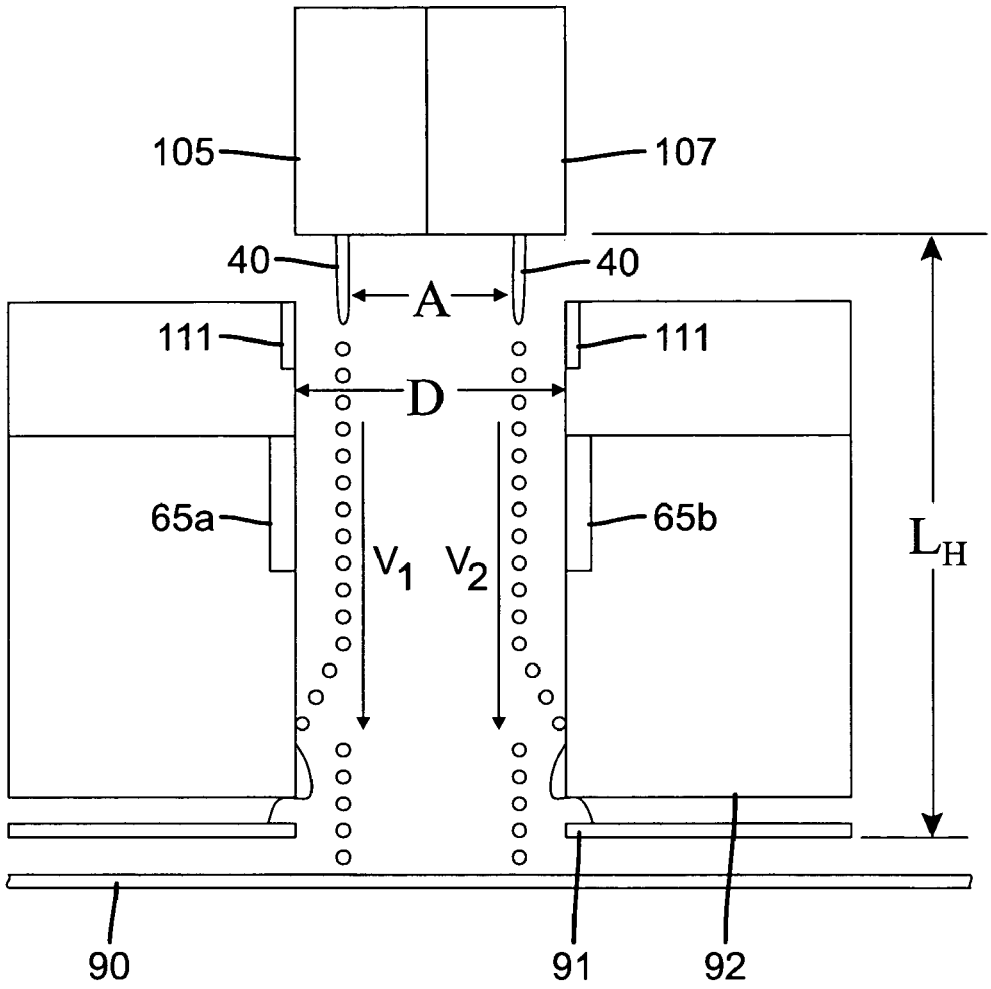
FIG. 9 shows a side view of a 2 row nozzle array and deflection electrode as per a preferred embodiment of the invention.

A side view of a print-head according to another preferred embodiment of the invention is shown in FIG. 9. In this embodiment two rows of nozzles separated by inter-row spacing A are seen in side view producing jets 40 breaking off into drops in proximity to the planar charge electrodes 111. The "print-head length", $L_H$ is defined by the distance from the nozzle plate 103 to the exit plane of the head at the bottom surface 91 of the ink extraction means 92. The ink extraction means 92 removes ink that is collected on the gutters. This ink may be eventually discarded or recycled for future printing. Distance D is the minimal spacing between the two deflection electrodes 65*a* and 65*b*. In this preferred embodiment of the invention, deflection electrodes 65*a* and 65*b* are combined with the dual guttering means to produce a combined drop deflection/guttering means, but this is not mandated in alternate embodiments of the present invention. Obviously, inter-row spacing A is less than deflection electrode spacing D. In this particular embodiment the spacing D is shown to be uniform throughout the length of the channel formed by deflection electrodes 65*a* and 65*b* and between the dual guttering means. However, in other preferred embodiments of the invention, spacing D may vary especially between the dual guttering means that may be contoured to capture guttered drops more efficiently It is possible to construct such a print head with a wide range of values of inter-row spacing A. There are, however, advantages in limiting the deflection electrode spacing D (and the associated inter-row spacing A), to a range of values of under 400 um, when the duct is approximately sized according to the D>A relationship, and the electrode to jet spacing, C is sized such that $0.05 \leqq C/W \leqq 0.75$, and more preferably, $0.05 \leqq C/W \leqq 0.50$.

Limiting the deflection electrode spacing to under 400 um permits the use of matched collinear, airflow means as described in the U.S. patent application Publication No. 20040263586 entitled "Method and Apparatus for Conditioning Inkjet Fluid Drops Using Laminar Airflow". The collinear airflow means reduces aerodynamic interactions between the drops emitted by each of the linear nozzle arrays 105 and 107, thus improving the ultimate print quality. A "duct" is formed at least between deflection electrodes 65*a* and 65*b*. The duct can additionally be formed between the dual guttering means and between the planar charge electrode plates. Preferably, each of the continuous streams of drops is emitted into corresponding regions of the airflow with a drop velocity that substantially matches the specific airflow velocity of the particular region. When deflection electrode spacing D, wherein $D \leqq 400$ um is employed, the Reynolds number that results for the collinear airflow created within the duct formed at least between the deflection electrodes 65*a* and 65*b* at velocities matching practical drop velocities permits the development of a non-turbulent or laminar airflow to be established within the duct. The collinear airflow comprising a maximum velocity can be adjusted such that regional airflow velocities $V_1$ and $V_2$ of the regions into which each linear nozzle array 105 and 107 emit their respective drop streams, is matched to the respective drop velocities. Alternatively, the drop velocities can be adjusted to match the regional airflow velocities. One or more systems controllers may be used for any of these matching requirements. Matched velocities between the drops and the corresponding airflow regions into which the drops are emitted helps to counter the detrimental aerodynamic effects that the drops would encounter in the absence of such an airflow. An airflow that has laminar characteristic reduces turbulence effects that can additionally alter the required drop trajectories thus adversely affecting print quality. As previously discussed the inter-row spacing A is less than the deflection electrode spacing D. Therefore, preferred embodiments of the invention will preferably also have an inter-row spacing A, which is less than D which in turn is preferably less than 400 um. Needless to say, sufficient clearance between the jets 40 and the planar charge electrodes and deflection electrodes must also be considered. With respect to the planar charge electrodes, the charge electrodes will also be sized and positioned such that the associated C/W ratio is less than 0.75, and preferably less than 0.50.

Figure 10:
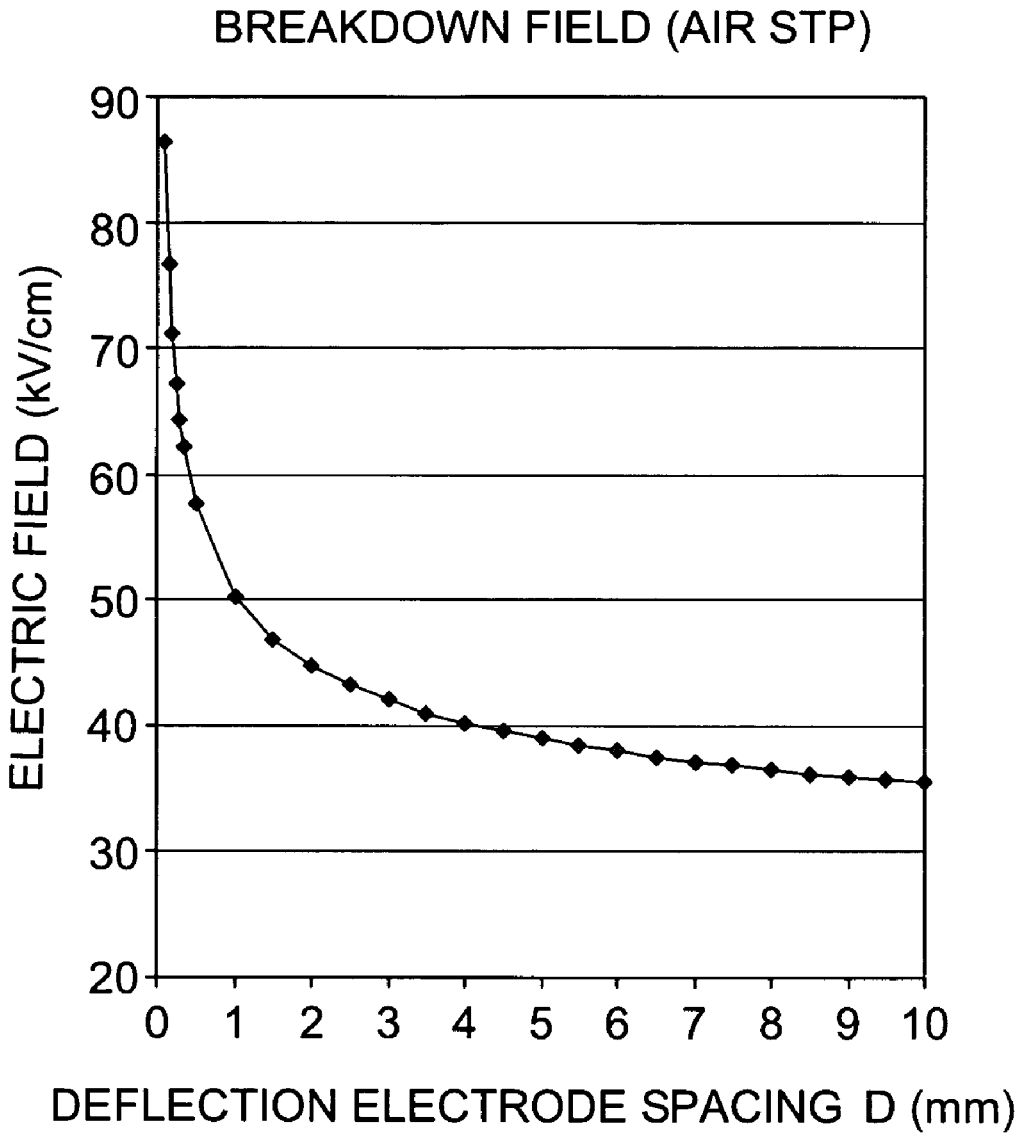
FIG. 10 shows a graph simulating maximum electric field strength as a function of deflection electrode spacing (Paschen Effect)

Limiting the deflection electrode spacing D to a smaller size also has the added benefit of permitting much higher deflection fields. High deflection fields are possible at the narrow gap distances due to what is known as the "Paschen" effect. In the book entitled "Spark Discharge" CRC Press, Boca Raton (1998), Bazelyan, E. M. and Raizer, Yu. P. describe the Paschen phenomenon wherein a nonlinear increase in the breakdown field in a gas occurs when the distance between electrodes is narrowed. This increase in the breakdown field is caused by a reduced number of electron-gas molecule collisions that occur within a narrow electrode gap where path lengths for electron transit are relatively shorter. FIG. 10 shows the enhanced electrical field breakdown (in air) found at narrow deflection electrode spacing D. It quickly becomes evident that by using the Paschen effect, the deflection field strength can be more than two or three times greater with deflection electrode spacing is in the 100-400 um range than for larger spacings. This increased deflection field strength latitude allows for the stronger deflection of charged drops to a gutter means. The guttered drop's trajectory is shortened, thereby reducing overall print-head length $L_H$ and improving drop placement accuracy for printed drops.

Figure 11:
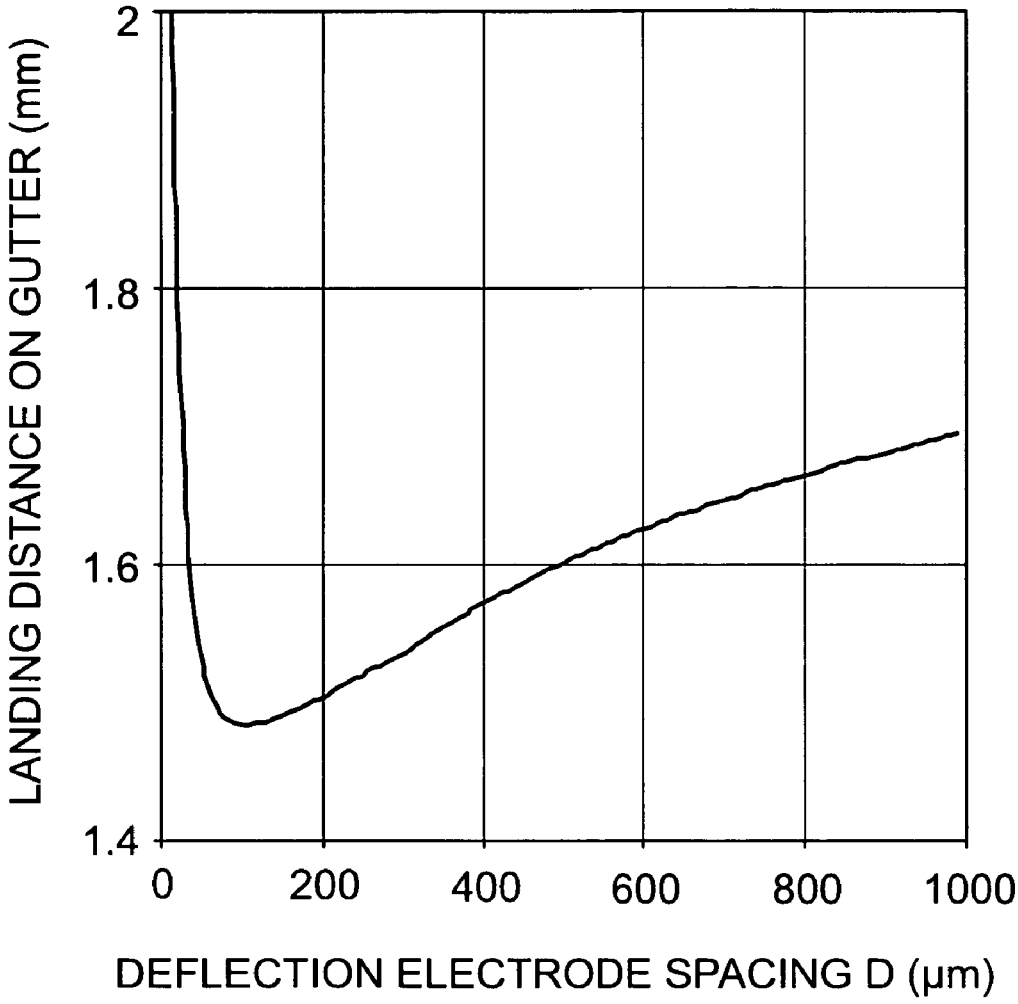
FIG. 11 shows a graph simulating landing distance on the gutter as a function of deflection electrode spacing for a given drop charge level and deflection field.

FIG. 11 shows a graph that simulates how a deflected charged drop's landing distance on the gutters changes as function of changing the deflection electrode spacing D. The curve shown in the graph is based upon a planar charge electrode-to-jet spacing C of 50 um, an applied charging potential of +/−50 volts applied to the planar charge electrodes and the deflection field is half that of the breakdown field shown in FIG. 10. The factor of "0.50" is a safety factor to allow for more reliable operation of the print-head away from the breakdown limit. The graph in FIG. 11 shows that a minimum landing distance on the gutter (i.e. the minimum guttered drop trajectory) is found for a deflection electrode spacing D in the range 75 um to 300 um. Inter-row spacing A will also be in these ranges since A<D. It should be noted that the significant rise in guttering distance with a very narrow deflection electrode spacing D (i.e.<approximately 75 um) results because the fixed potential applied to a given planar charge electrode will impart less charge to its corresponding drops emitted by a given row of nozzles due to the influence effects of the opposite potential planar charge electrodes on the opposing row of nozzles. It is evident that there is a benefit of a reduced landing distance for a deflection electrode spacing D and an inter-row spacing A between 75 urn and 300 urn over that of arrays constructed with a greater or lesser inter-row spacing and deflection electrode spacing.

Figure 12:
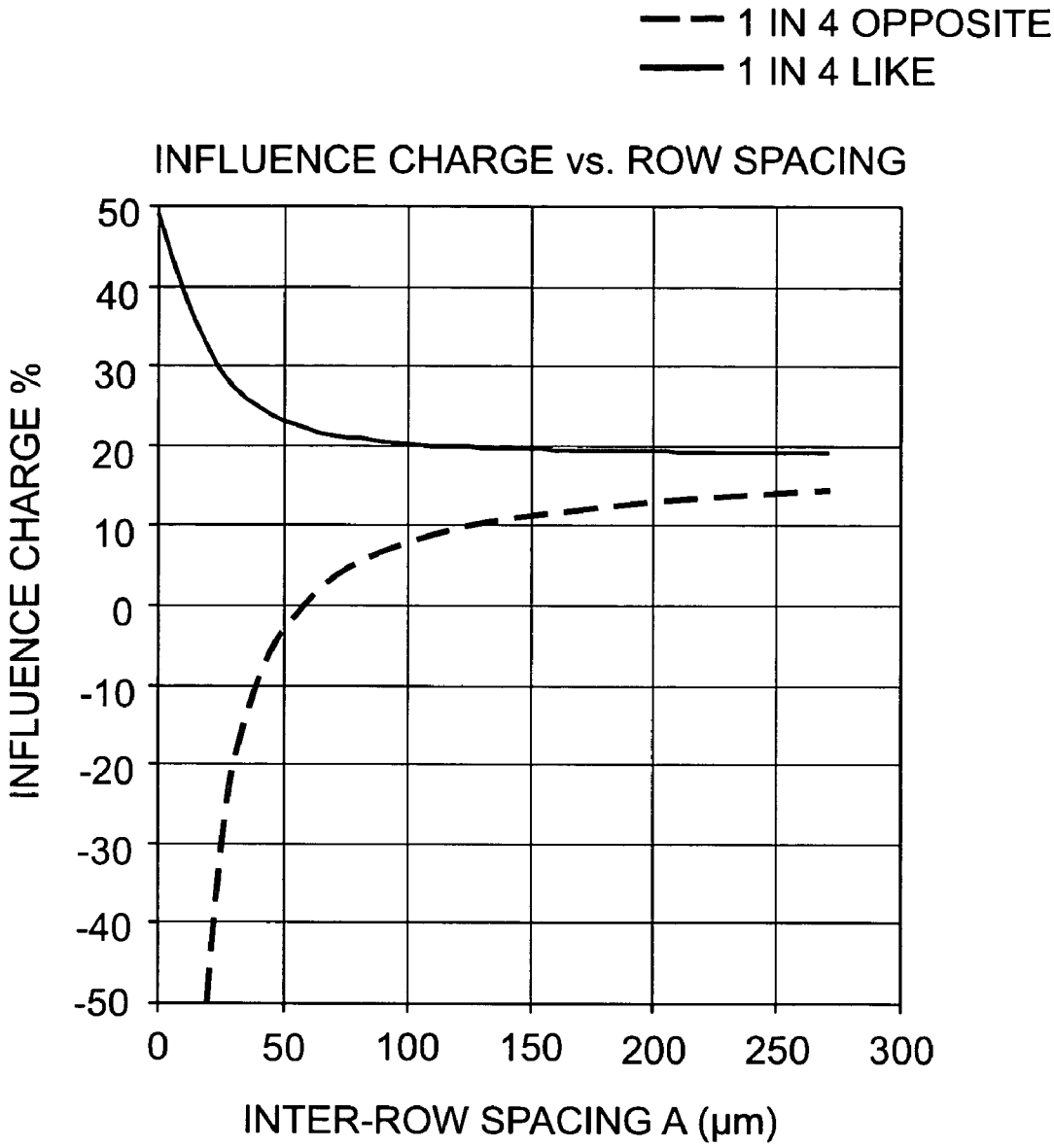
FIG. 12 shows a graph simulating relative magnitude of influence charging as a function of inter-row spacing for different drop charging schemes, including a print-head as per the preferred embodiment of the invention.

The graph of FIG. 12 simulates the influence charge on a given neutral print drop (i.e. a drop that is substantially not charged) as a function of inter-row spacing A of a preferred embodiment of the invention which comprises a dual row print-head with dimensions A=250 um, B=42.5 um (i.e. a 600 dpi two row array), C=26 um, and W=68 um. The definitions of variables A, B, C and W are as previously defined in this application. In this graph, the C/W ratio is advantageously equal to 0.38. FIG. 12 shows the effects of an influence charge on a print drop characterized by grounding its corresponding planar charge electrode. The influence charge is shown as a percentage of the nominal charge on a fully charged guard drop. Curves are shown for two separate cases. In the first case, like charges are imparted on all non-printing drops regardless of the two rows of nozzles they are emitted from. As previously stated, such a case requires two deflection fields typically provided by the addition of a centrally positioned deflection electrode. The second case represents a preferred embodiment of the invention in which opposite charges in opposing rows are imparted on all non-printing drops. In the second case, all charged non-printing drops can be deflected by a single deflection field without the need for a centrally positioned deflection electrode. A 1:4 guard drop scheme is employed in both cases. It is evident that by employing the preferred embodiment of the invention with opposite charges on opposite rows, an appropriate selection of an inter-row spacing A can be chosen such that the unintended influence charge is zero or near zero. For most ranges of inter-row spacing A the opposite charge case has a corresponding smaller magnitude of associated influence charge than the case in which drops are charged with an identical polarity. Surprisingly, it is apparent that for modest inter-row spacings of 30 um or greater most of the influence charge reduction can be achieved. Such small inter-row spacings A further permit an associated deflection electrode spacing D to remain small enough to further benefit from the Paschen effect and the low Reynolds number air flow.

From this graph (FIG. 12) it is seen that the distance A should be greater than or equal to B/2 to limit the nozzle to nozzle interactions. Most of the influence charge reduction is achieved at an inter-row spacing A of 30 um, which is approximately ¾B. These surprisingly low levels of cross-talk are produced without the need for electrostatic shielding being positioned between the rows of jets. It appears that for inter-row spacing A≧B/2 each row of jets serves as electrostatic shielding for the other row of jets.

From this analysis it is clear that inter-row spacing A≧B/2. It has also been seen that the inter-row spacing should be less than the deflection electrode spacing D and that ideally D≦400 um.

The preferred embodiments of the invention previously described establish that the influence charging of neighboring planar charge electrodes can be made substantially zero, or a small predetermined value. This advantageous situation can especially be assured in preferred embodiments of the present invention in which a guard drop scheme is employed. Guard drop schemes can be additionally employed counter data-dependent crosstalk effects by "nozzle-to-nozzle" and "drop-to-drop" electrostatic cross talk effects.

Influence charging has been described as the electrostatic influence induced on a given jet by the charging of a directly adjacent planar charge electrode from a state high to a state low. The directly adjacent planar electrode can be on the same row or can be in a directly adjacent in a neighboring row. A guard drop scheme typically employs one or more gutter drops between any two adjacent print-selectable drops. The two adjacent print-selectable drops may be on the same row or on neighboring rows. Therefore nozzle-to-nozzle crosstalk is described as the electrostatic influence induced on a first print-selectable jet by the charging of the nearest second print-selectable jet. The nearest print-selectable jet is defined by the particular guard drop scheme employed.

Drop-to-drop crosstalk can occur between consecutive drops within a given drop stream or between adjacent or neighboring drops, each of the drops emitted from neighboring drop streams. Such drops may be emitted from the same row of nozzles or from separate rows of nozzles. In both cases, the charging of the print-selectable jets is print-data dependant. Both nozzle-to-nozzle crosstalk and drop-to-drop crosstalk are also data dependant. As herein described the term "crosstalk" can refer to nozzle-to-nozzle crosstalk or drop-to drop crosstalk or a combination of the two.

Figure 13:
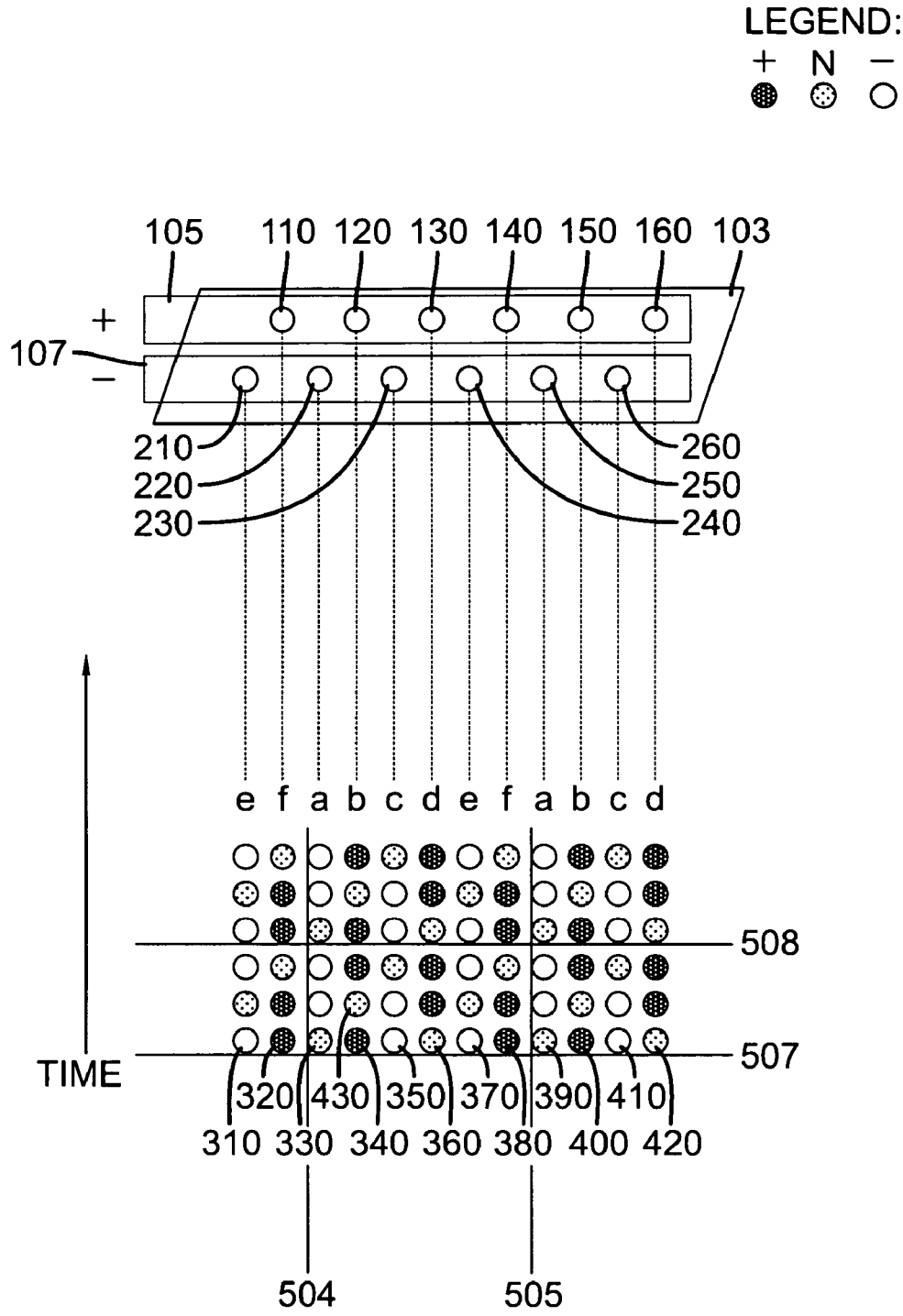
FIG. 13 shows a 1:3 guard drop scheme employed by a preferred embodiment of the invention.

Preferred embodiments of the invention employing guard drop schemes can also reduce the variation in the charging of guttered drops that would otherwise be seen in a high-resolution single row array. This reduced charge variation allows the building of a shorter print-head with resulting improved print quality Preferred embodiments of the invention as shown in FIG. 8 and of which employing guard drop schemes are herein described. Turning now to FIG. 13 we consider inkjet nozzle 220 of inkjet nozzle array 107. We denote its charging sequence by the letter a. We consider the case where nozzle 220 produces a neutral inkjet fluid drop with the intent of having this drop print a dot on recording surface 90 (not shown in FIG. 13). We shall refer to such a drop as a print-selected drop and to the corresponding nozzle of interest as a print-selected inkjet nozzle. In order to minimize the crosstalk between drops emanating from nearest neighbor nozzles 210, 110, 120 and 230, nozzles 210 and 230 produce at the same time drops that are negatively charged and nozzles 110 and 120 produce drops that are positively charged. Each of the charged drops is charged by a corresponding planar charge electrode (not shown). The induced effect of the two nearest neighboring positively charged planar charge electrodes is substantially equal to the induced effect of the two nearest neighbor negatively charged planar charge electrodes and therefore the electrostatic influence on the drop produced by nozzle 220 is thereby strongly reduced. The sum of the induced charges on the print-selected drop is substantially zero or a small predetermined value, said value depending in part on the nozzle-to-nozzle spacing and inter-row spacing of the arrays as previously described. The use of the surrounding neighboring drop charges to reduce induced charge variations on a specific drop, typically a print-selected drop, is referred to as a "guard drop scheme". The charged drops, which surround the print-selected drop, are referred to as "guard drops". In the absence of this "guard drop" charging sequence, there are substantial data dependent differences in charge induced on the drop emitted from nozzle 220. On the same clock cycle of the drop generation clock where print-selected drop at nozzle 220 is uncharged, the next nozzle available to produce a neutral printing drop under this scheme would be at nozzle 130, which would be "guarded" from induced charge by the combined effect of positive charges at nozzles 120 and 140 on array 105, and negative charges at nozzles 230 and 240 on array 107. Crosstalk effects on print-selected drop 220 due to the different possible charge states on drop 130, (neutral for printing, positive for non-printing), also exist and can be managed as discussed below.

The linear repeat period of inkjet print-head for one guard drop charging scheme described in this particular embodiment, has every third nozzle in the combined pattern from both linear inkjet nozzle array 105 and linear inkjet nozzle array 107 producing a neutral drop. This may be most easily seen by considering the drop charges produced at the same time by nozzles 110 to 160 and 210 to 260. Nozzles 110, 120, 130, 140, 150 and 160 produce drops 320, 340, 360, 380, 400 and 420, while nozzles 210, 220, 230, 240, 250 and 260 produce drops 310, 330, 350, 370, 390 and 410. Neutral drops are shown as hatched, positive drops are shown as solid, and negative drops are shown as empty in FIG. 13. With nozzle 220 producing a neutral drop, the nearest nozzle that may again be neutral, while maintaining the minimum crosstalk scheme described above, is nozzle 130 of Inkjet nozzle array 105. Under these circumstances the drops produced by the various nozzles of inkjet nozzle arrays 105 and 107 have the charges as shown on drops 310 to 420 in FIG. 13 at the time represented by line 507. Neutral drops are found at positions a, d, a, d . . . . Note that in this schematic the drops are shown in a single row for the sake of clarity only, whereas the drop placement pattern produced on the recording surface being printed upon would depend on the drop generation rate, print drop selection and the relative speed between the array and the medium.

In the forgoing sections, the interrelationship between the charging of the different nozzles in linear inkjet nozzle arrays 105 and 107 were explained for the case where example nozzle 220 was selected for printing and was therefore made neutral. On the next clock cycle of the drop generation frequency, the next nozzle selected for printing might be nozzle 120, followed by nozzle 230. When nozzle 120 is selected to print, drops from nozzles 220 and 230 have to be negatively charged while drops from nozzles 110 and 130 have to be positively charged. This is depicted by the second row of inkjet drop charge states in FIG. 13, indicated as being printed at a later time than the numbered first row. The third row of inkjet drop charge states represents the third and last step in the nozzle print sequence scheme described herewith. In this case nozzle 230 is producing a neutral drop while nozzles 220 and 240 produce negative drops and nozzles 120 and 130 produce positive drops. This is but one arrangement and it will be obvious to practitioners in the field that other nozzle print sequence schemes are possible.

It is evident that the pattern may be repeated from this point onwards in cycles of three charge state selections. In this particular nozzle print sequence scheme, the drops from nozzles 220, 120, 230, 130, 240, and 140 respectively have charge state sequences a, b, c, d, e, and f and form a unit cell of charge states in the linear dimension delineated by lines 504 and 505 in FIG. 13, and a repeating pattern of neutral printing drops at a period in the linear dimension of every three nozzles along both combined arrays (also every three nozzles on either array). In respect of time, the charge state sequence of a particular nozzle repeats with every third drop emitted by that nozzle. The permissible sequence of drops bounded by lines 507 and 508 in FIG. 13 is therefore repeated. This cyclic arrangement of 3 charge states in both the linear and temporal dimension is referred to herein as a 1-in-3, or 1:3 guard drop scheme.

Figure 14:
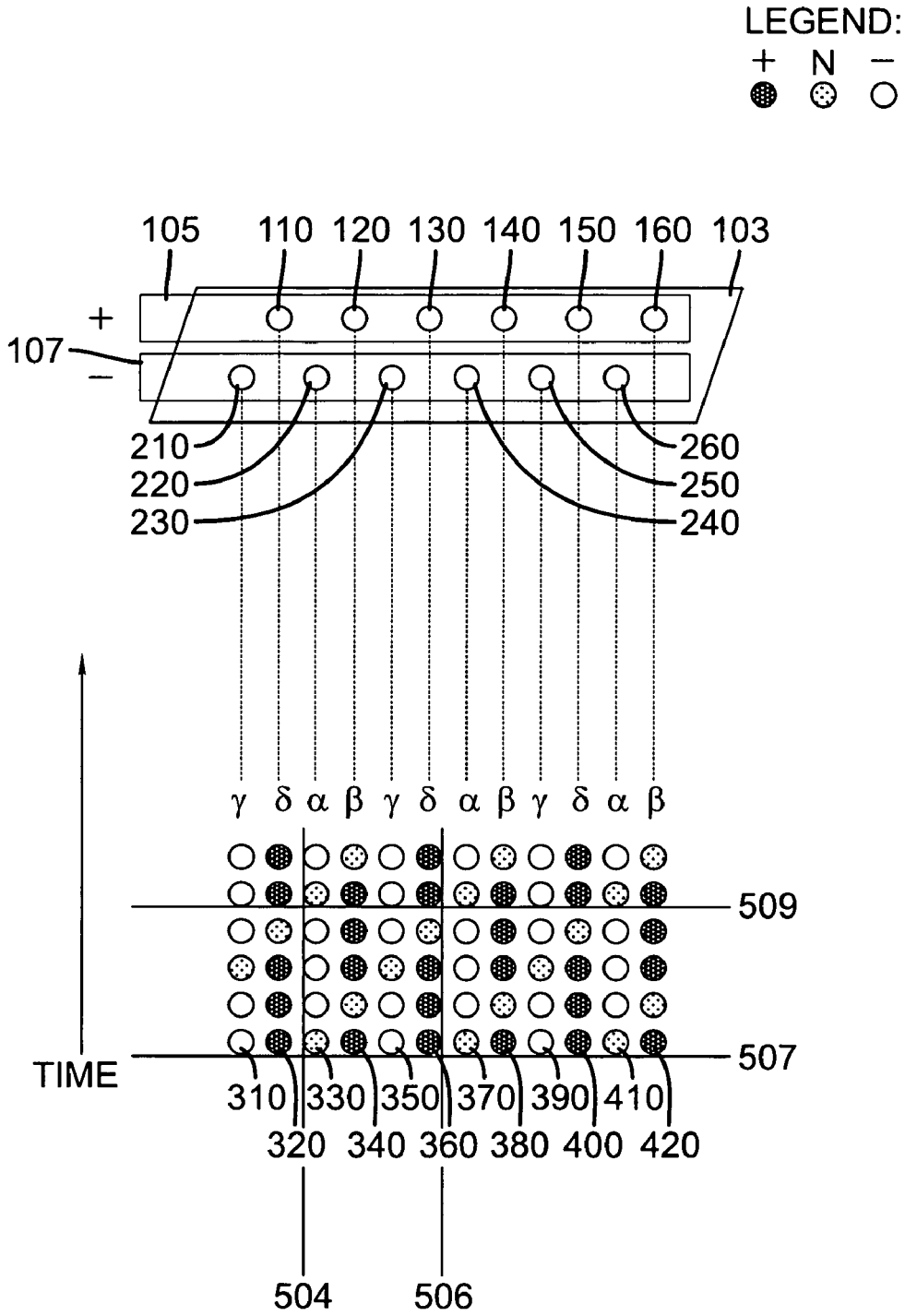
FIG. 14 shows a 1:4 guard drop scheme employed by a preferred embodiment of the invention.

In another preferred embodiment of the invention the charge state sequence repeats in a pattern of 4 charge states, with every fourth drop emitted from a given nozzle being available for selection as a neutral printing drop. This cyclic arrangement of charge states in referred herein as a 1-in-4 or 1:4 guard drop scheme and is shown in FIG. 14. In said 1:4 guard drop scheme, had the first print-selected nozzle to produce a neutral drop been nozzle 220 of array 107, the next available drop to print on the same clock cycle is on array 107 at nozzle 240. In this scheme, when array 107 has a print-selected drop, all of the nozzles on array 105 are charged positively (none are available for printing), and nozzle 230 on array 107 is charged negatively. As in the 1:3 guard drop scheme, the negative charges on nozzles 210 and 230 and the positive charges on nozzles 110 and 120, balance to produce a net induced charge on the drop formed at nozzle 220 that is substantially zero, or a small predetermined value, said value depending in part on the nozzle-to-nozzle and inter-row spacing of the arrays. Crosstalk effects on print-selected drop 220 due to the different possible charge states on drop 240, (neutral for printing, negative for non-printing), also exist and can be managed as discussed below.

It is evident that the pattern may be repeated in time as well as linearly in cycles of four charge state selections. In this particular nozzle print sequence scheme, the drops from nozzles 220, 120, 230, and 130, respectively have charge state sequences $\alpha$, $\beta$, $\gamma$ and $\delta$, and form a unit cell of the arrangement delineated in space by lines 504 and 506 in FIG. 14, and a repeating pattern of neutral printing drops at a period in the linear dimension of every four nozzles along both combined arrays (every two nozzles on either array). In respect of time, the charge state sequence of a particular nozzle repeats with every fourth drop emitted by that nozzle. The permissible sequence of drops bounded by lines 507 and 509 in FIG. 14 is therefore repeated in time.

Figure 15:
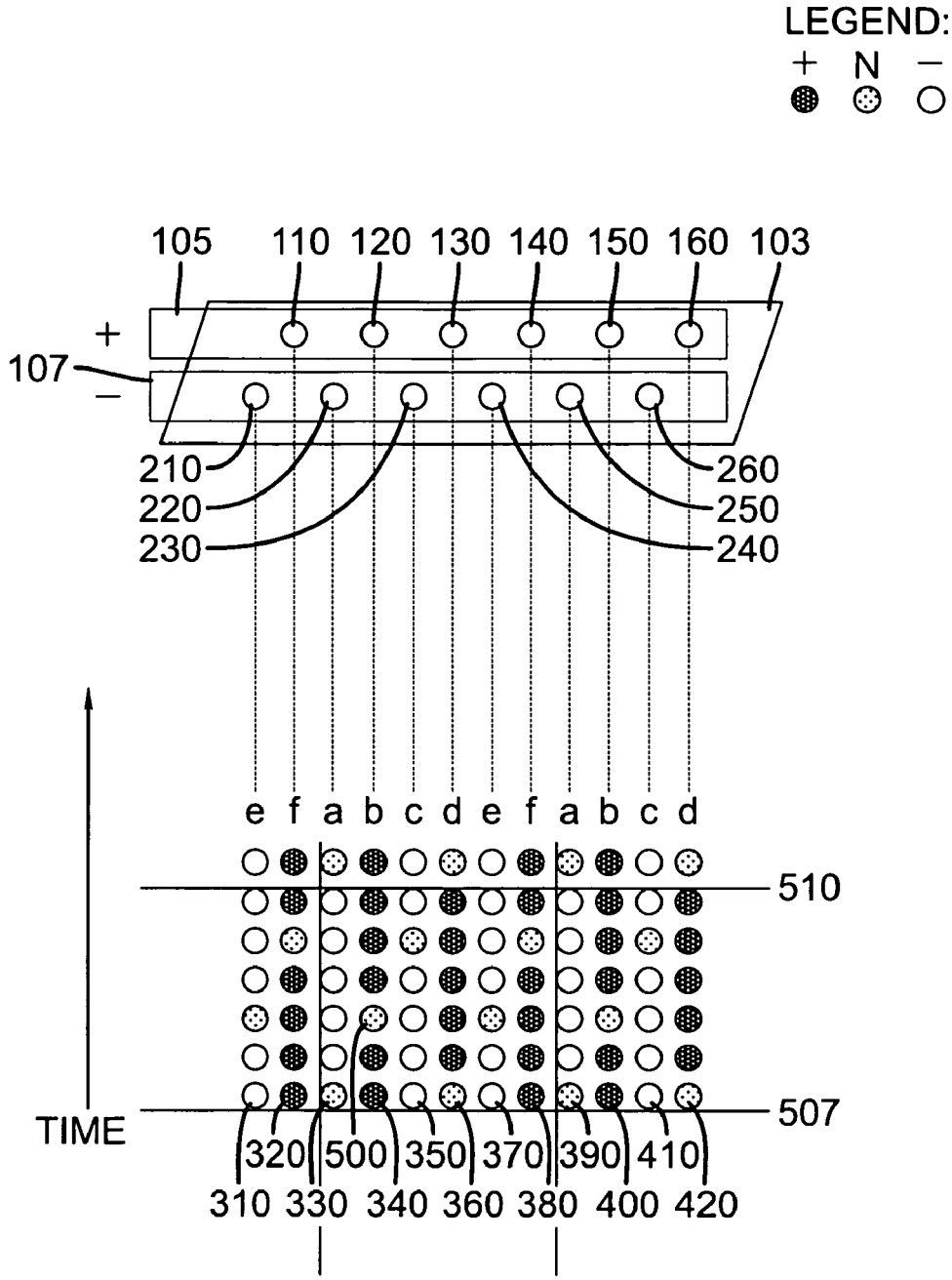
FIG. 15 shows a 1:3:6 guard drop scheme employed by a preferred embodiment of the invention.
Figure 16:
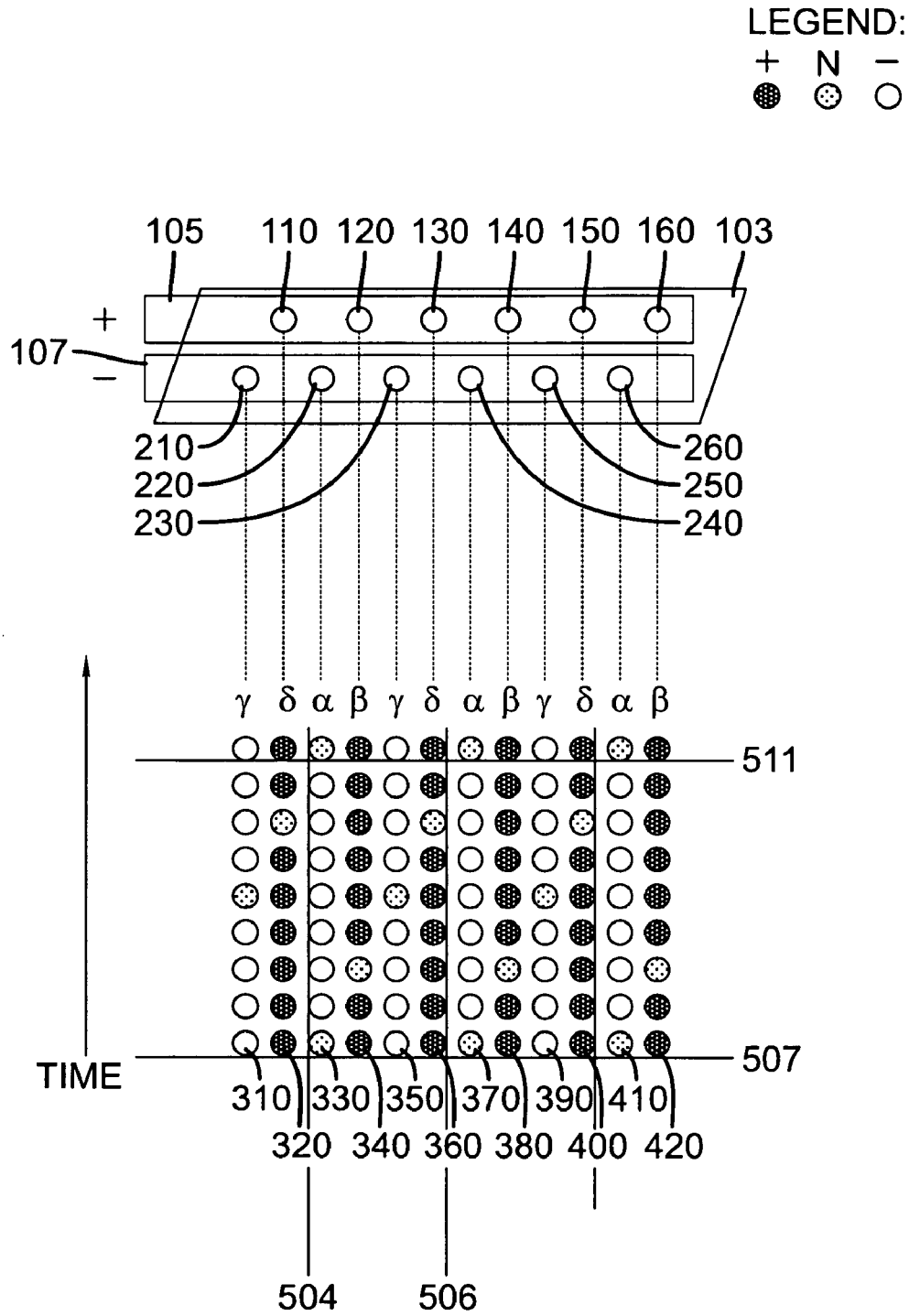
FIG. 16 shows a 1:4:8 guard drop scheme employed by a preferred embodiment of the invention.

FIG. 15 and FIG. 16 show alternative preferred embodiments of the invention that employ additional rows of guard drops in time between print-selected drops disclosed in the 1:3 and 1:4 guard drop schemes. In these instances, the additional guard drops act to reduce undesirable electrostatic influence between the drops, but do so at the expense of reduced drop availability for printing. With these schemes, characterized by intermediate rows consisting entirely of guard drops, drop-to-drop interactions are reduced and the number of drops is reduced by half as indicated. Thus the printing rate is also reduced by half with these guard drop schemes. Guard drops schemes labeled 1:3:6, and 1:4:8, are therefore shown in FIG. 15 and FIG. 16 respectively.

Figure 17:
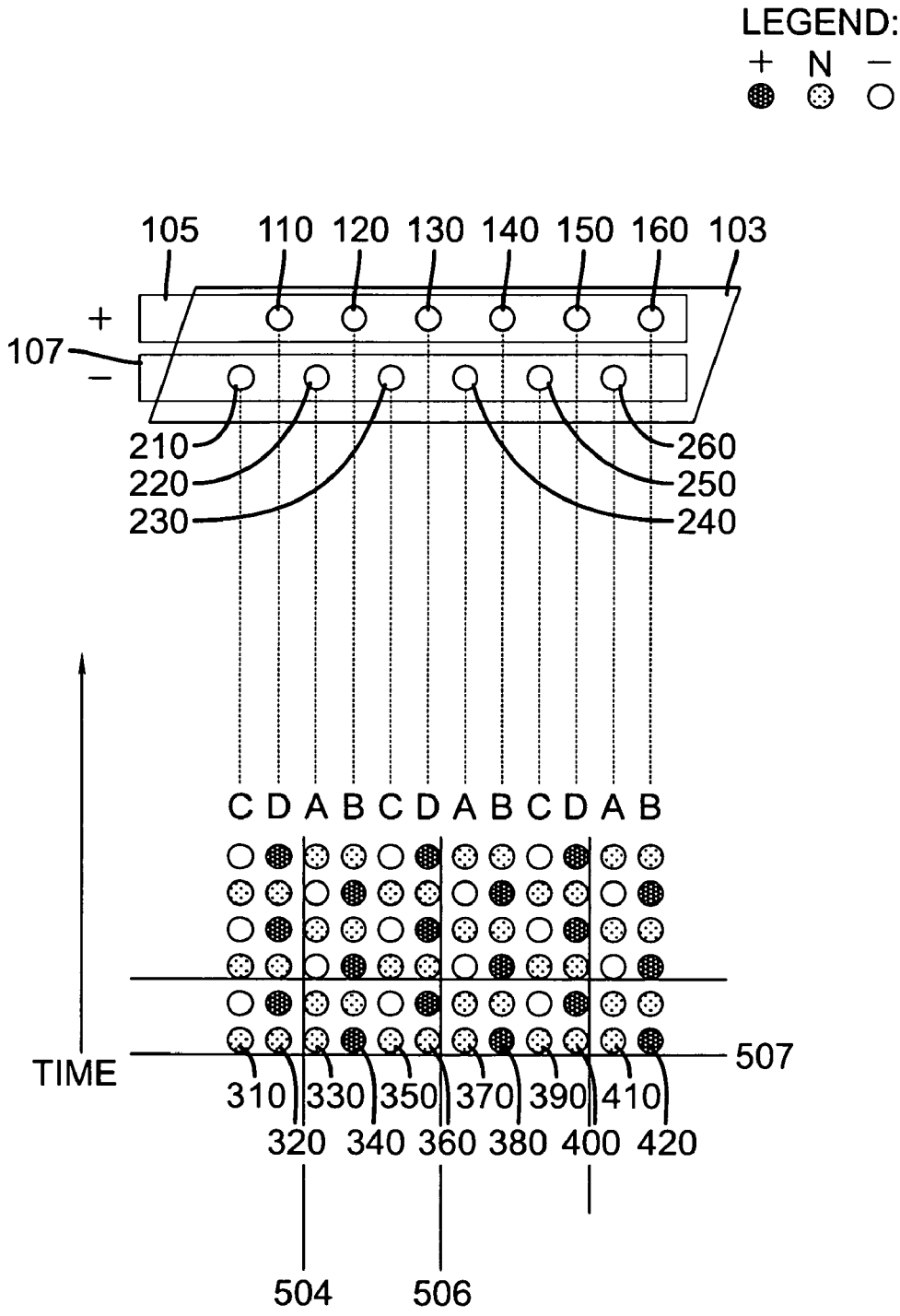
FIG. 17 shows a 1:2 guard drop scheme employed by a preferred embodiment of the invention.

A 1-in-2 (1:2) guard drop scheme may be employed between the two rows of nozzles in yet another preferred embodiment of the invention as shown in FIG. 17. In this embodiment each row 105 and 107 operates with every second drop available for printing irrespective of the print-selectable state of drops in the other row. The drop print-selectable state then changes to the alternate drops in each of the rows on every print cycle. In this embodiment shown, row 105 has positively charged guard drops while row 107 has negatively charged guard drops. Print-selected drops can occur simultaneously at adjacent (offset) positions on the opposite rows, thereby increasing crosstalk, but with a sufficiently large inter-row spacing this crosstalk is manageable for some print applications. With an inter-row spacing on the order of a 200 to 300 um, crosstalk effects are roughly twice that seen if a 1:4 guard drop scheme were to be employed. An embodiment of the invention employing a 1:2 guard drop scheme may lead to lower quality printing. However, print-selected drops are twice in number with respect to the 1:4 guard drop scheme, allowing for higher speed printing.

It will be evident to practitioners in the field of inkjet printer technology that various other nozzle print sequence schemes may be implemented that trade off levels of influence and crosstalk against the number of drops available for printing. In the preferred embodiments of the invention, we have worked with the principle that the entire recording surface is to be printed upon; that is, that all available printing drops are intended to be left neutral as shown in FIGS. 13, 14, 15, 16, and 17. Of course, the actual image being printed will not in general require that all drops be printed. Accordingly, the "printing drops" should be referred to as print-selectable drops. According to the chosen guard drop scheme, a print-selectable drop is defined within in the drop sequence, to be left neutral if that print-selectable drop is to become a print-selected drop. In the case where the print-selectable drop is not selected to become a print-selected drop, the print-selectable drop will be charged and guttered along with the neighboring gutter drops. The term print-selectable nozzle refers to the corresponding nozzle from which the print-selectable drop is emitted. The term print-selected drop or print-selected nozzle will refer to those drops and corresponding nozzles that are selected by print data to be neutral and deposited on the recording surface.

It will also be clear to practitioners in the field of inkjet printing that the charge on a print-selected drop need not be zero, but merely needs to be of a consistent value, so that the drop may be electrostatically directed to the recording surface. In a preferred embodiment of the present invention, the sum of the induced charge by the nearest neighbor drops is of a predetermined value. This value is determined such that the drop in question may be consistently guided to the recording surface between the two guttering deflection electrodes. This implementation allows almost the same degree of deposition control as the case where the sum of the induced charges on the print-selected drop is substantially zero. The only additional perturbing effect being in-flight electrostatic interactions of print-selected drops.

In another preferred embodiment of the present invention, a print-selected drop may not be entirely uncharged, but charged with a small charge of predetermined value, the sign of said charge on the print-selected drop being opposite to that of the sign of the charge assigned to guard drops within the same row from which said print-selected drop is chosen. The opposite sign of the charge of predetermined value on said print-selected drop causes the drop to move away from the nearest guttering electrode of the same sign, and to which guard drops from the same row are guttered, and to deposit on the recording surface in a position more central to the array head and in a manner controlled by the magnitude of the predetermined charge and the electric field strength determined by the guttering electrodes.

As previously discussed, in addition to influence charging, other forms of crosstalk are present in an electrostatic printhead. The two principle types of crosstalk are nozzle-to-nozzle crosstalk and drop-to-drop crosstalk, both of which are print data dependant. By way of example, nozzle-to-nozzle crosstalk can be demonstrated in FIG. 13 and results from the difference in influence charging of print-selected drop 330 at line 507, produced by nozzle 220, due to the presence or absence of charge on drop 360 at line 507, produced by nozzle 130. Also by way of example in FIG.13, drop-to-drop crosstalk is the effect of influence charging of drop 330 at line 507, produced by nozzle 220, due to the presence or absence of charge on drop 430, produced by nozzle 120 one drop-generation clock cycle ahead of drop 330. It is found that by changing the ratio of the dimensions in and between the nozzles in the arrays, it is possible to minimize the data dependent crosstalk variations. The non-data-dependent crosstalk that occurs in addition to these effects is a non-zero but near constant residual charge on the print-selected drop. This near constant residual charge is not problematic as it represents only a DC bias in the charging system that can be accommodated with the potential on the planar charge electrodes. The choice of dimensions is dependent on the nature of the guard drop scheme chosen, so that for example, a 1-in-3 guard drop scheme would have a different optimum set of dimensions for crosstalk minimization than a 1-in-4 guard drop scheme.

Figure 18:
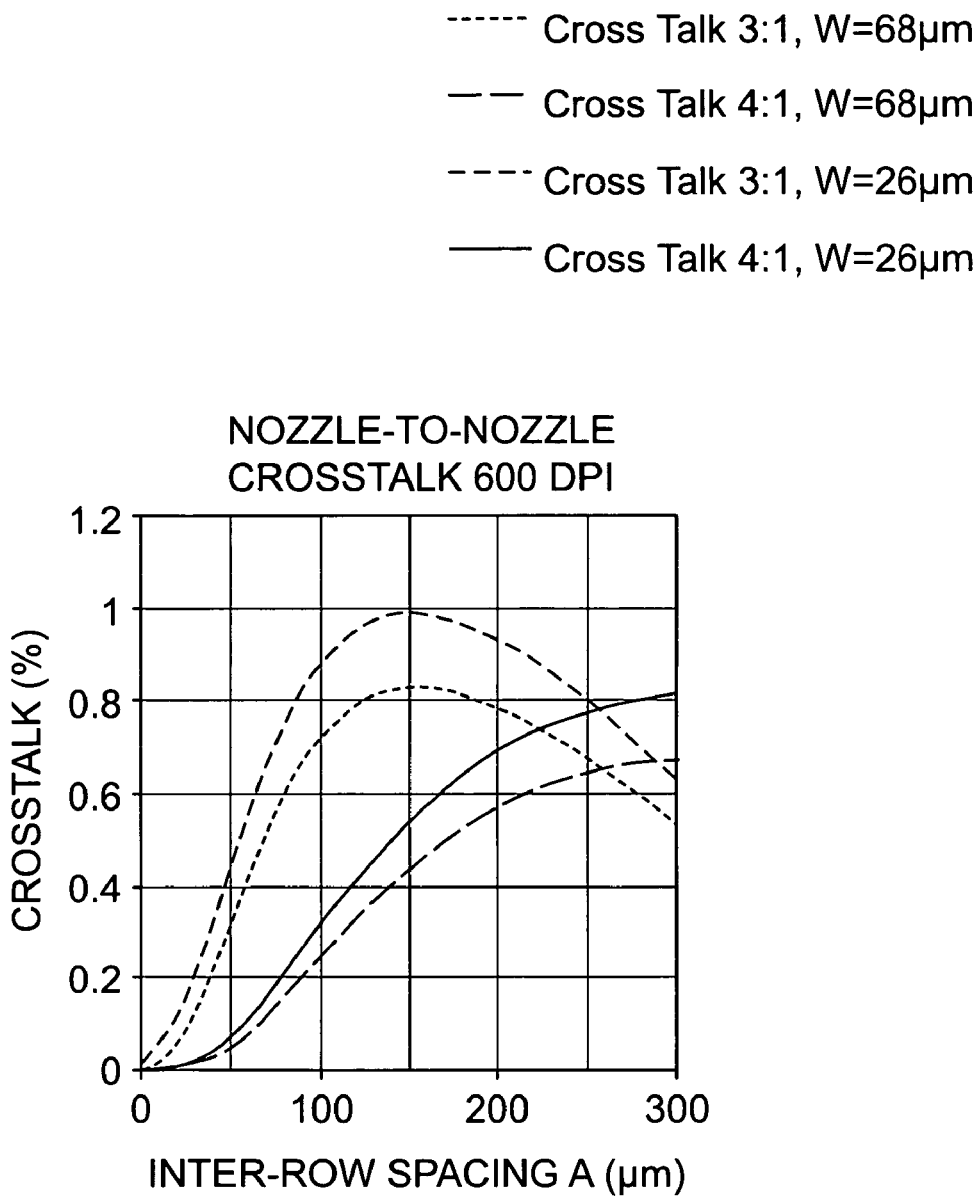
FIG. 18 shows a graph simulating the nozzle-to-nozzle crosstalk as a function of inter-row spacing for different guard drop schemes and planar charge electrode widths.

FIG. 18 shows a graph that simulates the effect of nozzle-to-nozzle crosstalk for a dual row print-head of a preferred embodiment of the invention. The graph curves represent a dual row print-head with an effective native 600 dpi resolution that further employs either a 1-in-3 and the 1-in-4 guard drop schemes. Further the planar charge electrode width W is also varied in the graphs. FIG. 18 simulates the difference in drop charge (nozzle-to-nozzle crosstalk) on a print-selected drop produced by a given print-selected nozzle when one of the nearest neighboring print-selectable nozzles is changed from a print-selected state to a non print-selected state. The nozzle-to-nozzle crosstalk curves are shown as the percentage difference (percentage of the nominal gutter charge) between the two cases. These curves show the relative amount of nozzle-to-nozzle data-dependent crosstalk as a function of the inter-row spacing, A. The data dependent nozzle-to-nozzle crosstalk for the described embodiment is at the level below 1% of the nominal gutter charge over the range of inter-row spacing A for all the cases graphed. The worst-case charge variation is twice the level shown in FIG. 18 as there are always 2 nearest print selectable neighbors one to the right and one to the left in the array. These nozzle-to-nozzle crosstalk values are well within a manageable level.

Figure 19:
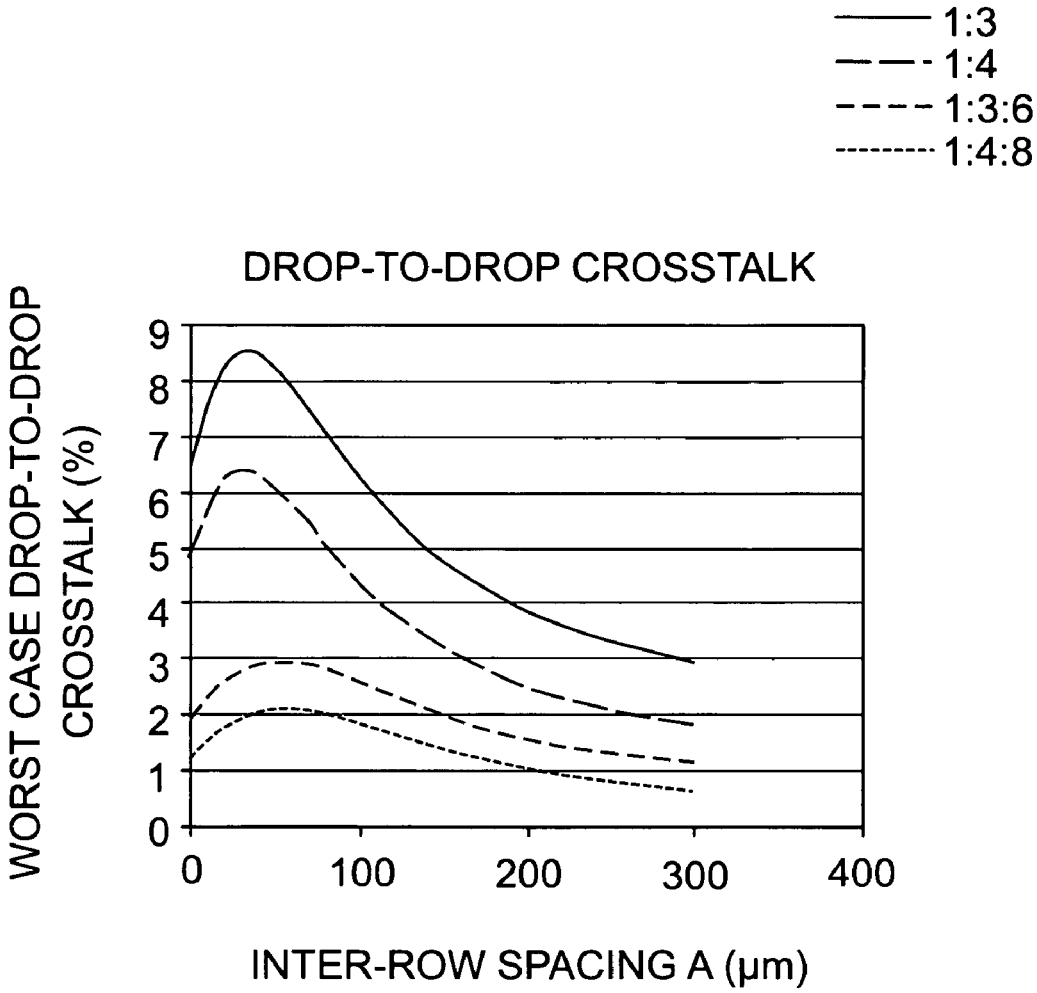
FIG. 19 shows a graph simulating the drop-to-drop crosstalk as a function of inter-row spacing for different guard drop schemes.

FIG. 19 shows a graph that simulates the effect of drop-to-drop crosstalk for a dual row print-head of a preferred embodiment of the invention. The graph curves represent a dual row print-head with an effective native 600 dpi resolution further employing various guard drop schemes. The graph shows the difference in drop-to-drop crosstalk that results when charge is induced on a print-selected drop by the previously emitted drops from adjacent nozzles. The curves shown represent of both the 1:3 and 1:4 guard-drop-schemes as well guard drop schemes for 1:4:8 and 1:3:6. The curves are representative of the worst-case scenario in which the nearby surrounding jets have the maximum number of print selected drops but only on one of the two rows. In this case there are no canceling drop-to-drop influences from the other row that is charged with the opposite sign. The plotted curves are the difference in charge as a percentage of the nominal gutter charge that results if all surrounding print selected drops are switched from one row to the other. The curve shows that the magnitude of the induced charge diminishes with increasing inter-row spacing, A. Over most of the range, the magnitude of the drop-to-drop data-dependent crosstalk is reduced with increasing row spacing A, and for increased numbers of guard drops. Drop-to-drop influences may be made arbitrarily small by adding rows of guard drops or otherwise restricting allowed data patterns.

The current high-speed printing requirements made on state-of-the art high-resolution inkjet printers typically requires single pass printing without a retrace and without interleaving of multiple print passes. This performance requirements can be achieved by a page wide print array that may consist of a number of sub-arrays aligned in a larger array. To reduce cost and complexity, it is further desirable to have a single page-wide high-resolution nozzle array assembly for each color and to have each of the nozzle arrays constructed on a single removable sub-segment (rather than having multiple lower resolution segments spatially separated and offset and aligned to produce an effective higher resolution array). These sub-segments may be preferably manufactured by MEMS techniques on substrates such as silicon. MEMS fabrication has the advantage of producing accurately machined, low cost structures suited to producing nozzle arrays of high quality and accuracy. Each of these sub segments may comprise preferred embodiments of the present invention. Additionally, in some cases, each of the entire page wide arrays may only consist of a single array. This single array may comprise preferred embodiments of the present invention.

It will be evident to practitioners in the field of inkjetting technology that various other design rules can be derived from this invention and the data derived from it in order to produce multi-row arrays with the aim of minimizing or otherwise optimizing the effects of drop placement errors of printed drops.

The invention has been described in detail with particular reference to certain preferred embodiments thereof, but it will be understood that variations and modifications can be effected within the spirit and scope of the invention.

The invention claimed is:

1. A continuous printing apparatus comprising:

a printhead including a first row of nozzles and a second row of nozzles, the first row of nozzles being spaced apart from the second row of nozzles by a distance A, the nozzles of the first row and the nozzles of the second row having a nozzle to nozzle spacing B when compared to each other; and a plurality of planar charging electrodes, one of the plurality of planar charging electrodes corresponding to each of the nozzles of the first row and the second row, wherein $A \geqq B/2$.

2. The apparatus of claim 1, further comprising:

a first deflection electrode and a second deflection electrode, the first deflection electrode being spaced apart from the second deflection electrode by a distance D, wherein $D>A$.

3. The apparatus of claim 2, wherein voltages are applied to the first and second deflection electrodes and the voltage applied to the first deflection electrode and the voltage applied to the second deflection electrode are of opposite polarity.

4. The apparatus of claim 3, wherein the voltage applied to the first deflection electrode and the voltage applied to the second deflection electrode are of the same magnitude.

5. The apparatus of claim 2, wherein the distance D by which the first deflection electrode and the second deflection electrode are spaced apart is less than 400 um.

6. The apparatus of claim 2, wherein the distance D by which the first deflection electrode and the second deflection electrode are spaced apart is between 75 um and 300 um.

7. The apparatus of claim 1, wherein the nozzles of the first row and the nozzles of the second row are offset relative to each other as viewed in a direction substantially perpendicular to the first row of nozzles.

8. The apparatus of claim 1, wherein the nozzles of the first row have a nozzle to nozzle spacing of 2B.

9. The apparatus of claim 1, wherein an area between the first row of nozzles and the second row of nozzles is free of electrostatic shielding.

10. The apparatus of claim 1, wherein the distance A by which the first row of nozzles and the second row of nozzles are spaced apart is less than 400 um.

11. The apparatus of claim 1, wherein the distance A by which the first row of nozzles and the second row of nozzles are spaced apart is between 75 um and 300 um.

12. A continuous printing apparatus comprising:

a printhead including a first row of nozzles and a second row of nozzles, the first row of nozzles being spaced apart from the second row of nozzles by a distance A, the nozzles of the first row and the nozzles of the second row having a nozzle to nozzle spacing B when compared to each other;

a plurality of charging electrodes, one of the plurality of charging electrodes corresponding to each of the nozzles of the first row and the second row, wherein $A \geqq B/2$; and each of the plurality of charging electrodes being positioned spaced apart from its corresponding nozzle by a distance C, each of the plurality of charging electrodes having a width W as viewed in a direction substantially perpendicular to the first row of nozzles, wherein $0.05 \leqq C/W \leqq 0.75$.

13. A continuous printing apparatus comprising:

a printhead including a first row of nozzles and a second row of nozzles, the first row of nozzles being spaced apart from the second row of nozzles by a distance A, the nozzles of the first row and the nozzles of the second row having a nozzle to nozzle spacing B when compared to each other;

a plurality of charging electrodes, one of the plurality of charging electrodes corresponding to each of the nozzles of the first tow and the second row, wherein $A \geqq B/2$; and each of the plurality of charging electrodes being positioned spaced apart from its corresponding nozzle by a distance C, each of the plurality of charging electrodes having a width W as viewed in a direction substantially perpendicular to the first row of nozzles, wherein $0.05 \leqq C/W \leqq 0.50$.

14. A method of printing comprising:

forming fluid streams by causing fluid to jet through nozzles of a first row of nozzles and a second row of nozzles, the first row of nozzles being spaced apart from the second row of nozzles by a distance A, the nozzles of the first row and the nozzles of the second row having a nozzle to nozzle spacing B when compared to each other;

creating fluid drops from the fluid streams using a drop generator;

selectively charging the fluid drops using a plurality of planar charging electrodes, one of the plurality of charging electrodes corresponding to each of the nozzles of the first row and the second row; and deflecting the charged fluid drops toward one of a gutter and a recording medium using a first deflection electrode and a second deflection electrode, the first deflection electrode being spaced apart from the second deflection electrode by a distance D, wherein $D>A \geqq B/2$.

15. A continuous printing apparatus comprising:

a printhead including a first row of nozzles and a second row of nozzles, the first row of nozzles being spaced apart from the second row of nozzles by a distance A, the nozzles of the first row and the nozzles of the second row having a nozzle to nozzle spacing B when compared to each other;

a first deflection electrode and a second deflection electrode, the first deflection electrode being spaced apart from the second deflection electrode by a distance D, wherein $D>A \geqq B/2$;

a plurality of charging electrodes, one of the plurality of charging electrodes corresponding to each of the nozzles of the first row and the second row; and each of the plurality of charging electrodes being positioned spaced apart from its corresponding nozzle by a distance C, each of the plurality of charging electrodes having a width W as viewed in a direction substantially perpendicular to the first row of nozzles, wherein $0.05 \leqq C/W \leqq 0.75$.

16. The apparatus of claim 15, wherein the nozzles of the first row and the nozzles of the second row are offset relative to each other as viewed in a direction substantially perpendicular to the first row of nozzles.

17. The apparatus claim 15, wherein the nozzles of the first row have a nozzle to nozzle spacing of 2B.

18. The apparatus of 15, wherein an area between the first row of nozzles and the second row of nozzles is free of electrostatic shielding.

19. A continuous printing apparatus comprising:

a printhead including a first row of nozzles and a second row of nozzles, the first row of nozzles being spaced apart from the second row of nozzles by a distance A, the nozzles of the first row and the nozzles of the second row having a nozzle to nozzle spacing B when compared to each other;

a first deflection electrode and a second deflection electrode, the first deflection electrode being spaced apart from the second deflection electrode by a distance D, wherein $D>A \geqq B/2$;

a plurality of charging electrodes, one of the plurality of charging electrodes corresponding to each of the nozzles of the first row and the second row; and each of the plurality of charging electrodes being positioned spaced apart from its corresponding nozzle by a distance C, each of the plurality of charging electrodes having a width W as viewed in a direction substantially perpendicular to the first row of nozzles, wherein $0.05 \leqq C/W \leqq 0.50$.

* * * * *

UNITED STATES PATENT AND TRADEMARK OFFICE

CERTIFICATE OF CORRECTION

PATENT NO. : 7,533,965 B2
APPLICATION NO. : 11/368565
DATED : May 19, 2009
INVENTOR(S) : Thomas W. Steiner It is certified that error appears in the above-identified patent and that said Letters Patent is hereby corrected as shown below:

| | |
|---|---|
| Claim 13, Col. 30, line 67 | In Claim 13, delete "tow" and insert --row--, therefor. |

Signed and Sealed this

Twenty-fifth Day of August, 2009

David J. Kappos

David J. Kappos
*Director of the United States Patent and Trademark Office*